US008646525B2

(12) United States Patent
Izgec et al.

(10) Patent No.: US 8,646,525 B2
(45) Date of Patent: Feb. 11, 2014

(54) SYSTEM AND METHOD FOR ENHANCING OIL RECOVERY FROM A SUBTERRANEAN RESERVOIR

(75) Inventors: Omer Izgec, Houston, TX (US); George Michael Shook, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 594 days.

(21) Appl. No.: 12/788,148

(22) Filed: May 26, 2010

(65) Prior Publication Data

US 2011/0290479 A1 Dec. 1, 2011

(51) Int. Cl.
*E21B 47/00* (2012.01)

(52) U.S. Cl.
USPC ..... 166/250.02; 166/252.1; 166/252.5; 166/268; 703/10

(58) Field of Classification Search
USPC ..... 166/250.02, 252.1, 252.5, 268; 702/6, 702/9, 10; 703/10
See application file for complete search history.

(56) References Cited

U.S. PATENT DOCUMENTS

| | | | |
|---|---|---|---|
| 4,034,810 | A | 7/1977 | Holloway |
| 4,703,797 | A | 11/1987 | Djabbarah |
| 2006/0020438 | A1 | 1/2006 | Huh et al. |
| 2009/0050331 | A1 | 2/2009 | Mahler et al. |
| 2009/0150097 | A1 | 6/2009 | Camilleri |
| 2010/0078168 | A1 | 4/2010 | Jackson et al. |
| 2010/0161292 | A1 * | 6/2010 | Shook et al. ..... 703/2 |
| 2010/0191516 | A1 | 7/2010 | Benish et al. |
| 2011/0320128 | A1 | 12/2011 | Shook |

FOREIGN PATENT DOCUMENTS

| | | |
|---|---|---|
| EP | 0745870 | 12/1996 |
| GB | 2445246 | 7/2008 |
| WO | WO 02054332 | 7/2002 |

OTHER PUBLICATIONS

PCT International Search Report regarding PCT/US2011/037366 dated Oct. 27, 2011 (3 pgs).
Alhuthali, Ahmed H., et al., Optimal Waterflood Management Using Rate Control, SPE 102478 presented at 2006 SPE Annual Technical Conference and Exhibition, Sep. 24-27, 2006, San Antonio, TX.
Alhuthali, Ahmed H., et al., Optimal Rate Control Under Geologic Uncertainty, SPE 113628 presented at 2008 SPE/DOE Improved Oil Recovery Symposium, Apr. 19-23, 2008, Tulsa, OK.
Asheim, H., Maximization of Water Sweep Efficiency by Controlling Production and Injection Rates, SPE 18365 presented at the European Petroleum Conference, London, Oct. 16-19, 1998.
Brouwer, D.R., et al., Dynamic Optimization of Waterflooding with Smart Wells Using Optimal Control Theory, SPE Journal vol. 9, Iss. 4, pp. 391-402, SPE 78278-PA.

(Continued)

*Primary Examiner* — Yong-Suk (Philip) Ro
(74) *Attorney, Agent, or Firm* — Christopher D. Northcutt; Tiffany E. Weksberg

(57) ABSTRACT

A system and method for optimizing sweep efficiency of an enhanced oil recovery process in a subterranean reservoir is disclosed. The system and method include computing a displacement coefficient representative of heterogeneity of an unswept region in the subterranean. A functional relationship between operating conditions of one or more well control devices and the displacement coefficient is determined. The sweep efficiency of the enhanced oil recovery process can be optimized by adjusting the well control devices such that the displacement coefficient is minimized. Streamline simulation can be utilized to compute the displacement coefficient from the flow capacity and storage capacity of the unswept region in the subterranean reservoir.

13 Claims, 18 Drawing Sheets

(56) References Cited

OTHER PUBLICATIONS

Brouwer, D.R., et al., Recovery Increase Through Waterflooding with Smart Well Technology, SPE 68979 presented at the SPE European Formation Damage Conference, The Hague, The Netherlands, May 21-22, 2001.

Chen, Y. and Oliver, D.S., Ensemble-Based Closed-Loop Optimization Applied to Brugge Field, SPE 118926 presented at 2009 SPE Reservoir Simulation Symposium, Feb. 2-4, 2009, The Woodlands, TX.

Datta-Gupta, Akhil, et al., A Semianalytic Approach To Tracer Flow Modeling In Heterogeneous Permeable Media, *Advances in Water Resources*, (1995) vol. 18, No. 1, pp. 9-24.

Datta-Gupta, Akhil, Streamline Simulation: A Technology Update, *Journal of Petroleum Technology*, (2000) vol. 52 Issue 12, pp. 68-73, 84.

Grinestaff, G.H., Waterflood Pattern Allocations: Quantifying the Injector to Producer Relationship with Streamline Simulation, SPE 54616 presented at SPE Western Regional Meeting, May 26-28, 1999, Anchorage, Alaska.

Grinestaff, G.H., and Cafferey, D.J., Water Management: A Case Study of the Northwest Fault Block Area of Prudhoe Bay, Alaska, Using Streamline Simulation and Traditional Waterflood Analysis, SPE 63152 presented at SPE Annual Technical Conference and Exhibition, Oct. 1-4, 2000, Dallas, TX.

Idrobo, Eduardo A., et al., Swept Volume Calculation and Ranking of Geostatistical Reservoir Models Using Streamline Simulation, SPE 62557 presented at 2000 SPE/AAPG Western Regional Meeting, Jun. 19-23, 2002, Long Beach, CA.

Izgec, O., and Kabir, C.S., Establishing Injector/Producer Connectivity Before Breakthrough During Fluid Injection, SPE 121203 presented at SPE Western Regional Meeting, Mar. 25-26, 2009, San Jose, CA.

Kaufman, R.L., et al., Characterizing the Greater Burgan Field with Geochemical and Other Field Data, SPE Reservoir Eval. & Eng., vol. 3 (2), pp. 118-126, Apr. 2000 (SPE 62516).

Kaufman, R.L., Characterizing the Greater Burgan Field: Use of Geochemistry and Oil Fingerprinting, SPE Reservoir Eval. & Eng., vol. 5 (3), pp. 190-196, Jun. 2002 (SPE 78129).

Osako, I., et al., Timestep Selection During Streamline Simulation Through Transverse Flux Correction, SPE Journal, vol. 9 (4), pp. 459-464 (SPE 79688).

Peters, E., et al., Results of the Brugge Benchmark Study for Flooding Optimization and History Matching, SPE 119094 presented at 2009 SPE Reservoir Simulation Symposium, Feb. 2-4, 2009, The Woodlands, TX.

Sayarpour, M. et al., The Use of Capacitance—Resistance Models for Rapid Estimation of Waterflood Performance and Optimization, *Journal of Petroleum Science and Engineering*, vol. 69, Issues 3-4, Dec. 2009, pp. 227-238.

Schmalz, J.P., and Rahme, H.D., The Variation of Waterflood Performance with Variation in Permeability Profile, Prod. Monthly, vol. 15 (No. 9), pp. 9-12 (Sep. 1950).

Senocak, Didem, et al., Effective Use of Heterogeneity Measures in the Evaluation of a Mature CO2 Flood, SPE 113977 presented at 2008 SPE/DOE Improved Oil Recovery Symposium Apr. 19-23, 2008, Tulsa, OK.

Shook, G.M. and Mitchell, K.M., A Robust Measure of Heterogeneity for Ranking Earth Models: The F-Phi Curve and Dynamic Lorenz Coefficient, SPE 124625 presented at SPE Annual Technical Conference and Exhibition, Oct. 4-7, 2009, New Orleans, LA.

Smalley, P.C., et al., Reservoir Compartmentalization Assessed with Fluid Compositional Data, SPERE 9(3), pp. 175-180 (SPE 25005).

Sudaryanto, B., and Yortsos, Y.C., Optimization of Displacements in Porous Media Using Rate Control, SPE 71509 presented at the SPE Annual Technical Conference and Exhibition, New Orleans, LA, Sep. 30-Oct. 3, 2001.

Terrado, M., et al., Waterflooding Surveillance and Monitoring: Putting Principles into Practice, SPEREE 10(5), pp. 552-562 (SPE 102200).

Thiele, Marco R., and Batycky, R.P., Using Streamline-Derived Injection Efficiencies for Improved Waterflood Management, SPEREE 9(2), pp. 187-196 (SPE 84080).

Thiele, Marco R., Streamline Simulation for Modern Reservoir-Engineering Workflows, Journal of Petroleum Technology, (2010) vol. 62, Issue 1, pp. 64-70 (SPE 118608).

Thiele, Marco R., Streamline Simulation, 8$^{th}$ International Forum on Reservoir Simulation, Jun. 20-24, 2005, Stresa/Lago Maggiore, Italy.

Wang, Y., et al., A Streamline Approach for Ranking Reservoir Models that Incorporates Production History, SPE 77377 presented at SPE Annual Technical Conference and Exhibition, Sep. 29-Oct. 2, 2002, San Antonio, TX.

Westrich, J.T., Fuex, A.m., O'Neal, P.M., and Halpern, H.I., Evaluating Reservoir Architecture in the Northern Gulf of Mexico with Oil and Gas Chemistry, SPEREE 2(6): 514-519 (SPE 59518).

Yeten, B., Castellini, A., Guyaguler, B., Chen, W.H., A Comparison Study on Experimental Design and Response Surface Methodologies, SPE 93347 presented at SPE Reservoir Simulation Symposium, Jan. 31-Feb. 2, 2005, Houston, TX.

* cited by examiner (A)

(B)

(A)

(B)

(A)

(B)

SYSTEM AND METHOD FOR ENHANCING OIL RECOVERY FROM A SUBTERRANEAN RESERVOIR

TECHNICAL FIELD

The present invention generally relates to an optimization system and method for enhancing oil recovery from a subterranean reservoir, and more particularly, to a system and method for enhancing oil recovery from a subterranean reservoir by optimization of volumetric sweep efficiency.

BACKGROUND

Reservoir systems, such as petroleum reservoirs, typically contain fluids such as water and a mixture of hydrocarbons such as oil and gas. Different mechanisms can be utilized such as primary, secondary or tertiary recovery processes to produce the hydrocarbons from the reservoir.

In a primary recovery process, hydrocarbons are displaced from a reservoir due to the high natural differential pressure between the reservoir and the bottomhole pressure within a wellbore. The reservoir's energy and natural forces drive the hydrocarbons contained in the reservoir into the production well and up to the surface. Artificial lift systems, such as sucker rod pumps, electrical submersible pumps or gas-lift systems, are often implemented in the primary production stage to reduce the bottomhole pressure within the well. Such systems increase the differential pressure between the reservoir and the wellbore intake; thus, increasing hydrocarbon production. However, even with the use of such artificial lift systems only a small fraction of the original-oil-in-place (OOIP) is typically recovered in a primary recovery process. This is the case because the reservoir pressure and the differential pressure between the reservoir and the wellbore intake declines overtime due to production. For example, typically only about 10-20% of the OOIP can be produced before primary recovery reaches its limit—either when the reservoir pressure is too low that the production rates are not economical, or when the proportions of gas or water in the production stream are too high.

In order to increase the production life of the reservoir, secondary or tertiary recovery processes can be used. Typically in these processes, fluids such as water, gas, polymer, surfactant, or combination thereof, are injected into the reservoir to maintain reservoir pressure and drive the hydrocarbons to production wells. Secondary and tertiary recovery processes have already converted billions of barrels of proven oil resources to reserves, and typically produce an additional 10-50% of OOIP to that produced during primary recovery. The most commonly used secondary recovery process is waterflooding, which is commonly referred to as an improved oil recovery (IOR) process and involves the injection of water into the reservoir to displace or physically sweep the residual oil to adjacent production wells.

The success of secondary or tertiary recovery processes, such as waterflooding, depends on its ability to sweep remaining oil efficiently. Various prediction techniques and management methods have been developed to aid in evaluating and optimizing the performance behavior of these recovery processes. For example, such prediction techniques and management methods include reservoir surveillance, pattern balancing, sensitivity studies centered on finite difference simulation, or a combination thereof. Prediction techniques provide insight on the upside oil recovery potential by estimating the fraction of a reservoir that has or has not been swept by an injected fluid. Typically these estimates are based on net injected fluid volumes. Management methods include finding the optimum injection scheme and well controls to maximize the recovery of oil in the unswept portion of the reservoir.

Based on the prediction and optimization results, actions are typically taken to improve the sweep efficiency in both new and mature flooding processes. Such actions can include optimizing rate allocation, mechanical and chemical conformance control, infill drilling, well conversion, pattern realignment, or a combination thereof. For example, flooding fluid can be redistributed in a reservoir by manipulating the pressure field via individual well controls. For instance, if a high permeability streak is identified in an inverted five-spot pattern during a waterflood recovery process, the rate of the center injection well can be reduced such that water can be reallocated to other quadrants in the pattern. Reducing the flow rate of the injection well can also delay breakthrough and reduce field water cut. Thus, areal sweep efficiency can be improved by reallocating fluid flow rates of wells. However, identifying the appropriate well controls can be difficult because changing a given bottomhole pressure can affect the distribution of the flooding fluid from multiple injection wells. Consequently, this action may inadvertently reduce the daily production rate of other surrounding production wells in the pattern and ultimately lead to an overall poor sweep for a given time.

Various optimum rate control methods have been put forth for resolving the complex interactions of wells and determining optimum operating conditions. In general, these methods are systematic approaches for determining optimum rate allocation to improve sweep through a reservoir. For example, an optimum rate control method can be directed to maximizing the displacement efficiency at water breakthrough. To accomplish this, an optimization method might try to ensure simultaneous water arrival at production wells. In this case, injection wells might be restricted to operate at their maximum allowable injection rate or be fully shut, and an optimization algorithm could be used to determine the optimal switch time between the injection well operating extremes.

Another example of a rate control method includes using inflow control valves (ICVs) along a well to maintain constant flow rates during the recovery process until the flooding fluid arrives at the production well. Various heuristic algorithms can be utilized to reduce the impact of high-permeability streaks on recovery performance. For example, an optimal rate allocation can reduce the distribution of water-arrival times at various segments along the production well. This rate control method is referred to as a static optimization of a flooding process. An extension of this static rate control optimization method employs smart wells and allows dynamic control of the ICVs. In this case, wells are equipped with numerous ICVs along their profile and optimization can be analyzed under rate-constrained and bottomhole-pressure-constrained well conditions. Net present value (NPV) can then be maximized by changing the rate profile along the well segments throughout the optimization period.

While the above conventional optimum rate control management methods are able to enhance oil recovery, they tend to be time-consuming as they rely on finite difference field models that contain relatively high-resolution numerical grids. Simulation is therefore, generally not practical with a vast number of wells or with large reservoir models as simulation is encumbered by the level of detail within the model. Furthermore, these methods generally fail to account for inter-well connectivity while optimizing sweep—a key factor influencing the complex interactions between wells. Rather, heterogeneity is defined in conventional models typically as a contrast in reservoir properties and thus, does not appropriately model reservoir flow paths between wells.

Streamline-based optimum rate control methods have been developed to overcome the aforementioned problems of conventional methods. Streamline models solve for fluid pressures on a grid and construct streamlines to describe flow geometry between sources and sinks. Streamlines are constructed such that they are normal to the pressure field and can take any arbitrary shape as they are not constructed along a finite difference grid. Streamline simulation can be used to quickly evaluate how the geology of a subsurface reservoir will impact flow, even for large reservoir models. Furthermore, streamline simulation directly accounts for dynamic heterogeneity in reservoir models as individual streamlines represent fluid-front propogation at various times between injection and production wells.

Initially streamlines were solely used for flow visualization and calculation of static allocation factors; however, recent methods have combined formal optimization approaches with streamlines. For example, one streamline-based optimization method relies on dynamic well allocation factors, as opposed to conventional static allocation factors. In this method, allocation factors are used to calculate the efficiency of each injection well, and the injection rates are subsequently reallocated to improve recovery performance. Another streamline-based waterflood optimization method is directed to equalizing the arrival time of the waterflood front at all production wells within selected sub-regions. This method also analytically calculates sensitivities of water arrival times to well controls. Other previously developed optimum rate control methods include optimizing recovery processes under geological uncertainty and performing ensemble-based closed-loop optimizations. Additionally, certain methods have incorporated saturation normalization to account for different rock types and localization to alleviate the effect of spurious correlations.

Despite these efforts, previous conventional rate control methods and streamline-base optimization methods fail to ensure optimal sweep efficiency of a reservoir. Moreover, these previous methods fail to directly optimize sweep efficiency at any arbitrary time during the flood, independent of the flood history. Such incorrect or insufficient flooding design can lead to increased costs associated with cycling of injection fluid and poor sweep, especially as a flooding process matures.

SUMMARY

According to an aspect of the present invention, a method is disclosed for optimizing sweep efficiency of an enhanced oil recovery process in a subterranean reservoir having a well associated with a well control device. The method includes the step of determining a functional relationship between an operating condition of the well control device and a displacement coefficient, such as the Hydrocarbon Lorenz Coefficient, which represents heterogeneity of an unswept region in the subterranean reservoir. The sweep efficiency of the enhanced oil recovery process is optimized by adjusting the operating conditions of the well control device responsive to the functional relationship such that the displacement coefficient is minimized. For example, the operating condition of the well control device can be a flowing bottomhole pressure, an injection rate, a voidage replacement ratio, or a combination thereof.

In one or more embodiments, determining the functional relationship includes performing a sensitivity analysis to identify the operating condition of the well control device that impacts the displacement coefficient. In one or more embodiments, the sensitivity analysis can include using Design of Experiment sampling techniques.

In one or more embodiments, determining the functional relationship includes using response surface methodology to represent a sensitivity of the displacement coefficient in terms of the operating condition of the well control device. For example, a response surface representing a sensitivity of the displacement coefficient can be constructed in terms of the operating condition of the well control device. The response surface can be minimized to determine an optimal operating condition of the well control device. The operating condition of the well control device can be adjusted to match the optimal operating condition of the well control device.

In one or more embodiments, determining the functional relationship includes computing flow capacity and storage capacity of the unswept region in the subterranean reservoir. In one or more embodiments, the displacement coefficient is computed from the flow capacity and the storage capacity of the unswept region in the subterranean reservoir.

In one or more embodiments, the displacement coefficient is computed using streamline simulation. For example, streamline segments being saturated with oil can be used to compute the displacement coefficient.

Another aspect of the present invention includes a method for optimizing sweep efficiency of an enhanced oil recovery process in a subterranean reservoir having an injection well and a production well. Flow capacity and storage capacity of an unswept region in the subterranean reservoir are computed. A displacement coefficient, which is indicative of heterogeneity of the unswept region in the subterranean reservoir, is computed from the flow capacity and the storage capacity of the unswept region in the subterranean reservoir. For example the displacement coefficient can be the Hydrocarbon Lorenz Coefficient. A functional relationship between the displacement coefficient and a well control device associated with the injection or production well is determined. The sweep efficiency of the enhanced oil recovery process is optimized by adjusting the well control device responsive to the functional relationship such that the displacement coefficient is minimized. For example, the well control device can be adjusted to alter a flowing bottomhole pressure, an injection rate, a voidage replacement ratio, or a combination thereof.

In one or more embodiments, the flow capacity and storage capacity are computed using streamline simulation. For example, streamline segments being saturated with oil can be used to compute the flow capacity and storage capacity.

In one or more embodiments, determining the functional relationship includes performing a sensitivity analysis to identify an operating condition of the well control device that impacts the displacement coefficient. In one or more embodiments, the sensitivity analysis can include using Design of Experiment sampling techniques.

In one or more embodiments, determining the functional relationship includes using response surface methodology to represent a sensitivity of the displacement coefficient in terms of at least one operating condition of the well control device such as flowing bottomhole pressure, an injection rate, a voidage replacement ratio, or a combination thereof. For example, a response surface representing a sensitivity of the displacement coefficient can be constructed in terms of the operating condition of the well control device. The response surface can be minimized to determine an optimal operating condition of the well control device. The operating condition of the well control device can be adjusted to match the optimal operating condition of the well control device.

Another aspect of the present invention includes a method for optimizing sweep efficiency of an enhanced oil recovery process in a subterranean reservoir having an injection well and a production well. Streamline simulation utilizing a reservoir flow model is performed to define streamlines representative of fluid flow between the injection well and the production well. A displacement coefficient indicative of heterogeneity in an unswept region of the subterranean reservoir is computed responsive to streamlines producing an oil volumetric flow. A functional relationship between the displacement coefficient and a well control device associated with the injection or production well is determined. The sweep efficiency of the enhanced oil recovery process is optimized by adjusting the well control device responsive to the functional relationship such that the displacement coefficient is minimized. For example, a flowing bottomhole pressure, an injection rate, a voidage replacement ratio, or a combination thereof, can be manipulated by adjusting the well control device.

In one or more embodiments, a simulation input deck defining operational values of the well control device is utilized for performing the streamline simulation. For example, the simulation input deck can be constructed using operational values of the well control device selected using a Design of Experiment sampling technique.

In one or more embodiments, determining the functional relationship includes using response surface methodology to represent a sensitivity of the displacement coefficient in terms of at least one operating condition of the well control device such as a flowing bottomhole pressure, an injection rate, a voidage replacement ratio, or a combination thereof. For example, a response surface representing a sensitivity of the displacement coefficient can be constructed in terms of the operating condition of the well control device. The response surface can be minimized to determine an optimal operating condition of the well control device. The operating condition of the well control device can be adjusted to match the optimal operating condition of the well control device.

In one or more embodiments, the flow capacity and storage capacity of the unswept region in the subterranean reservoir are computed. In one or more embodiments, the displacement coefficient is computed from the flow capacity and the storage capacity of the unswept region in the subterranean reservoir.

DETAILED DESCRIPTION

The system and method described herein are directed to optimizing enhanced oil recovery of reservoirs, particularly by maximizing sweep efficiency via well controls. As will be better understood by the further description below, the present system and method involve a procedure for sweep optimization.

In improved oil recovery (IOR) or enhanced oil recovery (EOR) processes, the volume of a reservoir contacted by an injected fluid is considered to be the swept or displaced volume of the reservoir. The percentage of original-oil-in-place (OOIP) displaced from a reservoir by a flooding fluid describes the sweep efficiency of the recovery process. Sweep efficiency is a function of reservoir heterogeneity, connectivity, and well pattern geometry. Design factors that impact the efficiency of a recovery process include, but are not limited to, selected injection patterns, placement of off-pattern wells, fracture connectivity in the reservoir, positions of gas-oil and oil/water contacts, reservoir thickness, permeability including areal and vertical heterogeneity, mobility ratios, density differences between the displacing and displaced fluids, and flow rates. As used herein, sweep efficiency is generally defined as the percentage of the reservoir volume displaced of oil by an injection fluid at a particular time.

Figure 1:
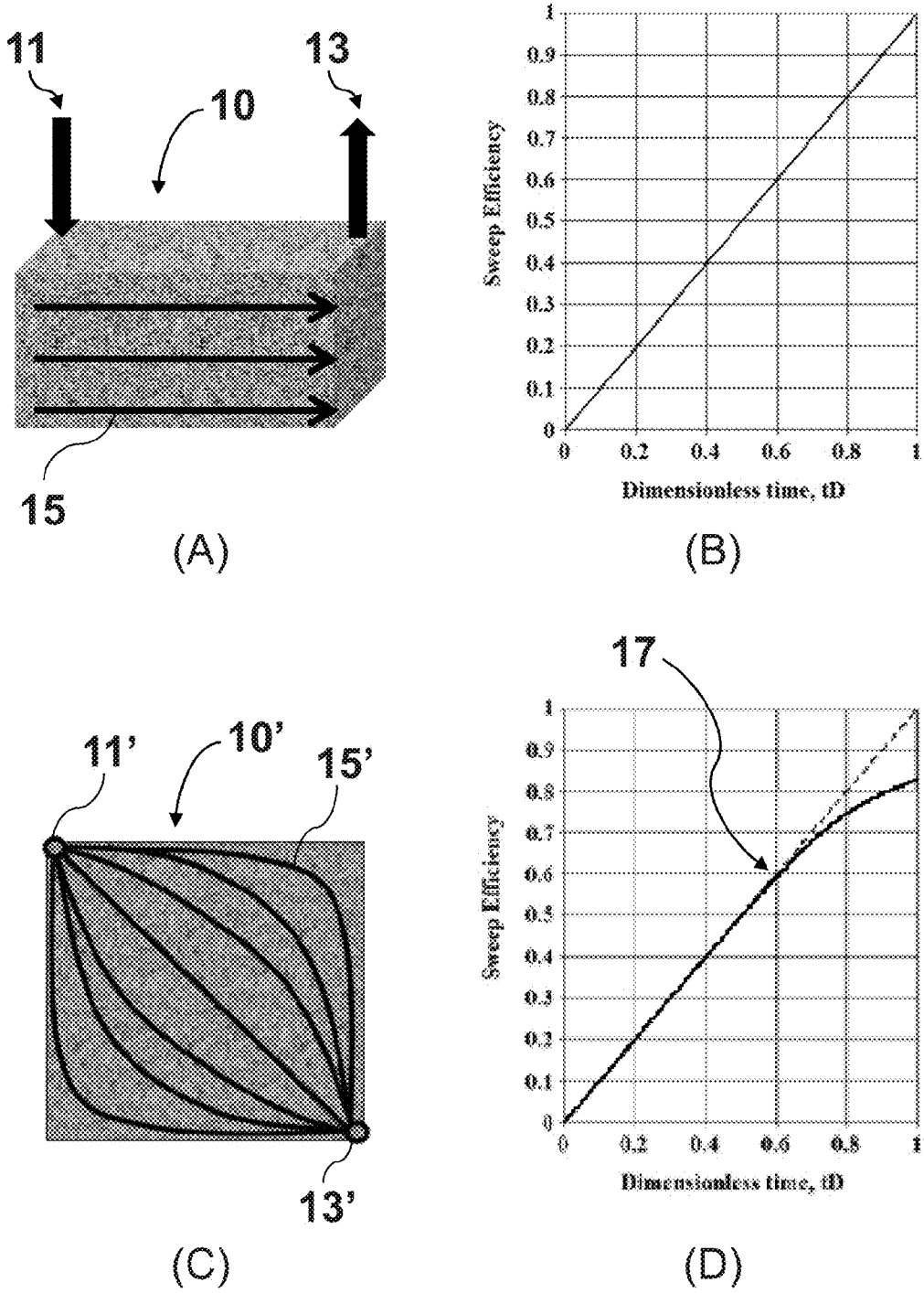
FIG. 1A is a schematic illustrating streamlines in a homogeneous reservoir domain.
FIG. 1B is a sweep efficiency history plot for the homogeneous reservoir domain shown in FIG. 1A.
FIG. 1C is a schematic illustrating streamlines in a homogeneous reservoir domain.
FIG. 1D is a sweep efficiency history plot for the homogeneous reservoir domain shown in FIG. 1C.

FIG. 1A is a schematic of a one-dimensional homogeneous reservoir domain 10. Domain 10 includes an injection well represented by reference number 11 and a production well represented by reference number 13. Injection fluid such as water, gas, steam, surfactant, or combination thereof, is injected into the homogeneous reservoir domain 10 through injection well 11 and sweeps through the porous media, shown by streamlines 15, displacing oil to production well 13. The porous medium of domain 10 has a simple reservoir geology that is perfectly homogeneous such that displacement has a piston-like front and there is no physical dispersion. Furthermore, unit mobility ratio is assumed such that the mobility of the displacing phase over that of the displaced phase is equal to one. Each streamline 15 has the same length and velocity, indicating an ideal sweep as each flow path has the same residence time. Sweep efficiency is typically reported as a function of dimensionless time and is frequently plotted as a sweep efficiency history ($E_V$ versus $t_D$). FIG. 1B shows a graph of an ideal sweep where a volumetric sweep efficiency of one ($E_V$=1.0) corresponds to one unit of dimensionless time ($t_D$=1), thus producing a 45 degree line representing perfect equality or distribution of flow in the reservoir.

FIG. 1C is a schematic of an isotropic three-dimensional homogeneous reservoir domain 10'. Injection well 11' and production well 13' are positioned at opposing corners of domain 10'. Fluid flow sweeps through the homogeneous porous media, shown by streamlines 15', displacing oil to production well 13'. Each streamline 15' has a different velocity and length due to the connectivity of the reservoir. For example, fractures, which can be described as open cracks or voids embedded within the homogeneous rock matrix, play an important role in allowing fluids to flow through the reservoir to reach a well. Such connectivity in the reservoir often produces fluid to an intersecting production well at a rate that greatly exceeds the rate of flow through the homogeneous rock matrix to the well, as the fracture typically has a much greater capability to transport fluids. Therefore, while domain 10' includes no heterogeneity, sweep falls below the 45 degree line representing a perfect equality of flow (dashed line) once breakthrough occurs. Accordingly, once injection fluid reaches production well 13', which is represented by breakthrough point 17 in FIG. 1D, sweep is considered to be imperfect.

Figure 2:
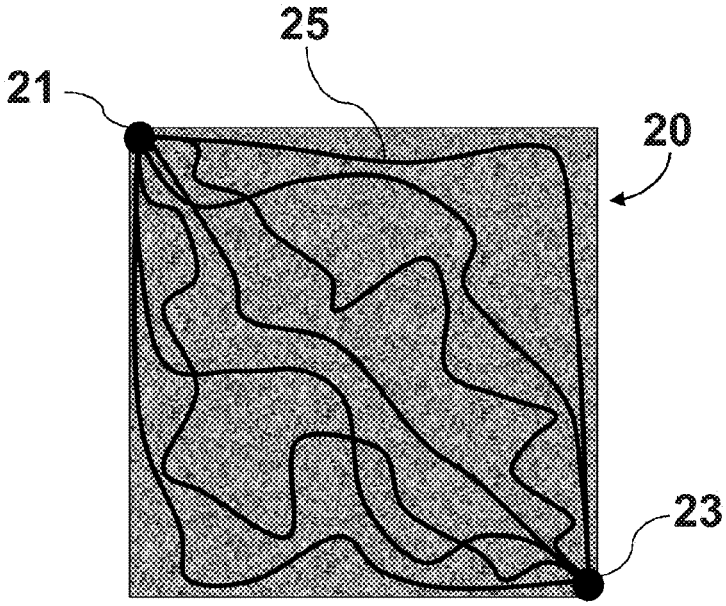
FIG. 2A is a schematic illustrating streamlines in a heterogeneous reservoir domain.
FIG. 2B is a sweep efficiency history plot for the heterogeneous reservoir domain shown in FIG. 2A.
Figure 2:
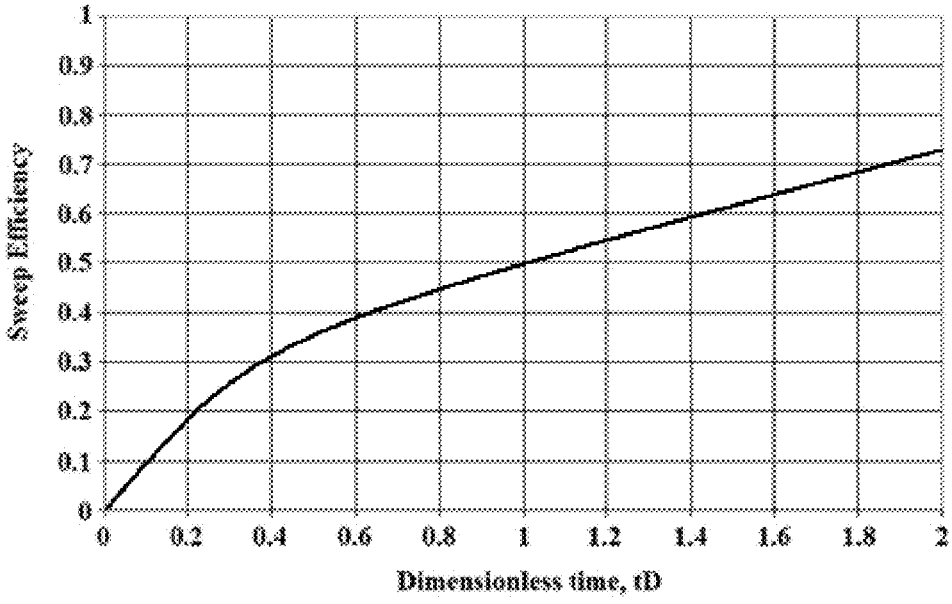

FIG. 2A is a schematic of a three-dimensional heterogeneous reservoir domain 20 including an injection well 21 and production well 23. Due to the connectivity of domain 20, as well as the variation in reservoir properties between injection well 21 and a production well 23, streamlines 25 vary in flow geometry such that each flow path does not have the same residence time. Accordingly, the sweep efficiency history in heterogeneous reservoir domain 20, which is depicted in FIG. 2B, falls below the 45 degree line representing a perfect equality of flow (FIG. 1B). This is because a volumetric sweep efficiency of one ($E_V$=1.0) is not achieved in one unit of dimensionless time. Furthermore, the sweep efficiency is much less than in homogeneous domain 10'. In particular, at one pore volume injected the sweep efficiency is only at about fifty percent. Accordingly, sweep efficiency of a reservoir is impacted by heterogeneity and connectivity of the reservoir.

Static flow capacity-storage capacity curves, which are also commonly referred to as F-C curves, can be generated to evaluate simple flow geometries. In particular, flow capacity-storage capacity curves can be constructed for individual flow paths within a layered reservoir. In this case, the flow paths are represented as layers that have unique values of permeability, porosity, cross sectional area, and length. The flow capacity of an individual streamline can be described as the volumetric flow of that layer, divided by the total volumetric flow. Therefore, the flow capacity $f_i$ can be computed using Darcy's law and defining N layers each having a different permeability k, porosity $\phi$, and thickness h using the following equation:

$$f_i = \frac{q_i}{\sum_{i=1}^{N} q_i} = \frac{(kh)_i}{\sum_{i=1}^{N} (kh)_i} \quad \text{(Equation 1)}$$

Similarly, the storage capacity of layer "i" can be computed as the layer pore volume divided by the total pore volume:

$$c_i = \frac{V_{P_i}}{\sum_{i=1}^{N} V_{P_i}} = \frac{(\varphi h)_i}{\sum_{i=1}^{N} (\varphi h)_i} \quad \text{(Equation 2)}$$

An F-C diagram is constructed by computing the cumulate distribution function of f and c. Therefore, the cumulative distribution functions for $F_i$, which represents the volumetric flow of all layers, and for $C_i$, which represents the pore volume associated with those layers, can be written as:

$$F_i = \frac{\sum_{j=1}^{i} q_j}{\sum_{j=1}^{N} q_i} = \frac{\sum_{j=1}^{i} (kh)_j}{\sum_{j=1}^{N} (kh)_j} \quad \text{(Equation 3)}$$

$$C_i = \frac{\sum_{j=1}^{i} Vp_j}{\sum_{j=1}^{N} Vp_j} = \frac{\sum_{j=1}^{i} (\varphi h)_j}{\sum_{j=1}^{N} (\varphi h)_j} \quad \text{(Equation 4)}$$

While these simple two-dimensional F-C curves can provide a basic understanding of flow geometry, they are based on the assumptions of constant intra-layer properties, uniform flow path lengths, equal pressure drops in each layer, and no cross flow between layers. However, as previously discussed with reference to FIG. 2A, flow path lengths in three-dimensional heterogeneous media are not constant. In particular, the pressure field created by the sink and source terms (production and injection wells) results in different flow path lengths due to connectivity and the variation in reservoir properties there between. Accordingly, such flow paths arising from static layer properties have proved to be less realistic and accurate compared those constructed using dynamic data.

The concepts behind static analysis of flow geometry using F-C curves can be expanded by relaxing the above assumptions. As will be described, F-C curves can be readily generalized to three-dimensional flow in heterogeneous media using streamlines from flow simulation runs. These dynamic curves provide a more accurate estimation of flow geometry and are referred to as Flow Capacity (F) vs. Storage Capacity (Φ) curves. To construct an F-Φ curve, streamline models are used to compute flow geometry using the "time of flight" (TOF) of the streamlines, $\tau_i$, and their volumetric flow rate, $q_i$. Typically a streamline simulator is operated a few time steps so pressure transients are attenuated and the simulation is at steady state prior to outputting such values. The "time of flight" (TOF) of a streamline is the time required for a volume of fluid to move from the start of a streamline, which is at the injection well, to the end of a streamline, which is at the production well. The volumetric flow rate, $q_i$, is the volume of fluid passing through a given streamline per unit time. The volumetric flow rate and "time of flight" output are used to calculate the individual streamlines' pore volume. The pore volume of the "i"th streamline can be determined by:

$$Vp_i = q_i \tau_i \quad \text{(Equation 5)}$$

where $Vp_i$ is the pore volume, $q_i$ is the volumetric flow rate assigned to the streamline, and $\tau_i$ is the time of flight (TOF). The streamlines can be ordered according to increasing residence time, such that they are arranged with a decreasing value of q/Vp. Flow capacity (F) and storage capacity (Φ) can then be calculated and plotted using the following:

$$F_i = \frac{\sum_{j=1}^{i} q_j}{\sum_{j=1}^{N} q_i} \quad \text{(Equation 6)}$$

$$\Phi_i = \frac{\sum_{j=1}^{i} Vp_j}{\sum_{j=1}^{N} Vp_j} \quad \text{(Equation 7)}$$

Figure 3:
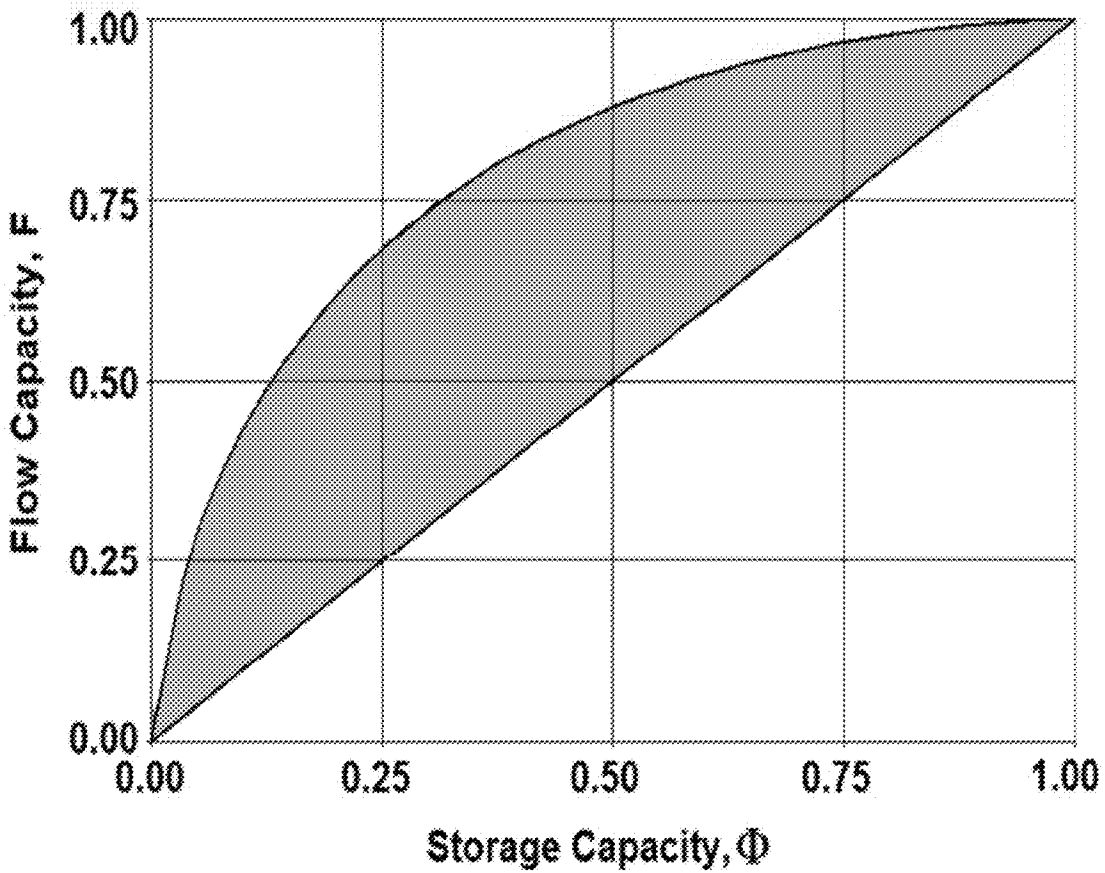
FIG. 3 is a Flow Capacity-Storage Capacity diagram, in accordance with an embodiment of the present invention.

FIG. 3 is a schematic of a Flow Capacity (F)-Storage Capacity (Φ) diagram. Similar to the sweep efficiency history plot ($E_V$ versus $t_D$) in FIG. 1B, a 45 degree line represents an ideal sweep efficiency where each streamline has same volumetric flow rate, q, and pore volume, Vp. Accordingly, all streamlines also have the same residence time. As will be described in more detail herein, divergence from the 45 degree line indicates heterogeneous displacement. Accordingly, F-Φ curves can be used to determine the dynamic or displacement heterogeneity of a subterranean reservoir. For example, the Lorenz coefficient is a robust indicator of displacement heterogeneity. Graphically the Lorenz coefficient can be described as two times the area between a F-Φ curve and the 45 degree line of ideal sweep, which is shown by the shaded area in FIG. 3. The Lorenz coefficient can be calculated using the following equation:

$$L_C = 2\left(\int_0^1 F d\Phi - 0.5\right) \quad \text{(Equation 8)}$$

A Lorenz coefficient, $L_C$, of zero means that the F-Φ curve represents a homogeneous displacement and falls along the 45° line. Accordingly, if the Lorenz coefficient is zero, there is equal volumetric flow from every incremental pore volume. A Lorenz coefficient value of one is referred to as "infinitely heterogeneous," and can be interpreted as all of the flow coming from a very small portion of the pore volume. Furthermore, the slope of the F-Φ curve is given by $$\left.\frac{dF}{d\Phi}\right|_i = \frac{t^*}{\tau_i} \quad \text{(Equation 9)}$$

where t* is the mean residence time of all streamlines and τ is the "time of flight" of the $i^{th}$ streamline. This indicates that the slope of the F-Φ curve is related to the degree of dynamic (or displacement) heterogeneity because if all streamlines have the same time of flight, the displacement is homogeneous as the curve has unit slope (dF/dΦ=1). Accordingly, the slope of a F-Φ curve implicitly captures the range of residence times of the individual streamlines, and the Lorenz coefficient, $L_C$, is an integral of that distribution. To emphasize that the Lorenz coefficient, $L_C$, describes the degree of dynamic heterogeneity, Equation 8 can be re-written as $$\begin{aligned} L_C &= 2\left(\int_0^1 F d\Phi - 0.5\right) \\ &= 2\left[\int_0^1 \left(\int_0^1 \frac{dF}{d\Phi} d\Phi\right) d\Phi - 0.5\right] \\ &= 2\left[\int_0^1 \left(\int_0^1 F' d\Phi\right) d\Phi - 0.5\right] \end{aligned} \quad \text{(Equation 10)}$$

Minimizing the derivative dF/dΦ over Φ=[0,1] results in a minimum value for the Lorenz coefficient, $L_C$.

Volumetric sweep efficiency, $E_v$, can also be obtained from Flow Capacity (F)-Storage Capacity (Φ) data. For example, swept volume as a function of time can be determined from the streamline time of flight distribution. Sweep efficiency can be estimated graphically from a F-Φ diagram as:

$$E_V(t) = \Phi(t) + \frac{1 - F(t)}{dF/d\Phi} \quad \text{(Equation 11)}$$

Furthermore, sweep efficiency can also be determined directly from F-Φ data using the equation:

$$E_V = \frac{q}{V_p} \int_0^{\tau} [1 - F(t)] d\tau \quad \text{(Equation 12)}$$

where the injection rate q is assumed constant. F and Φ can be determined at individual streamlines' breakthrough time, $\tau_i$. Therefore, the following naming convention will be used herein:

$$\Phi(t_i) = \Phi_i \quad \text{(Equation 13)}$$

$$F(t_i) = F_i \quad \text{(Equation 14)}$$

where $t_i$=the $i^{th}$ streamline's time-of-flight (TOF). Equation 12 can be integrated as $$E_V(t_i) = \frac{qt_i}{V_p} - \frac{q}{V_p}\int_0^{t_i} F(\tau)d\tau \quad \text{(Equation 15)}$$

Integration by parts gives:

$$E_V(t_i) = \frac{qt_i}{V_p} - \frac{q}{V_p}\left[F_i t_i - \int_0^{\Phi_i} t_i dF\right] \quad \text{(Equation 16)}$$
$$= \frac{qt_i}{V_p} - \frac{q}{V_p}\left[F_i t_i - \int_0^{\Phi_i} t_i \frac{dF}{d\Phi} d\Phi\right]$$

As defined in Equation 9, the derivative of the F-Φ curve is $$\left.\frac{dF}{d\Phi}\right|_i = \frac{t^*}{t_i}$$

where t* is mean residence time. Solving for $t_i$ gives $$t_i = \frac{t^*}{\left.\frac{dF}{d\Phi}\right|_i} = \frac{t^*}{F_i'} \quad \text{(Equation 17)}$$

Therefore, Equation 16 can be written and integrated to $$E_V(t_i) = \frac{qt_i}{V_p} - \frac{q}{V_p}\left[F_i t_i - \int_0^{\Phi_i} t^* d\Phi\right] \quad \text{(Equation 18)}$$
$$= \frac{qt_i}{V_p} - \frac{qt_i}{V_p}F_i - \frac{qt^*}{V_p}\Phi_i$$
$$= \frac{qt^*}{V_p F_i'} - \frac{qt^*}{V_p F_i'}F_i - \frac{qt^*}{V_p}\Phi_i$$

Alternatively, Equation16 can be written form of $t_i$ as $$E_V(t_i) = \frac{qt^*}{V_p}\left(\frac{1}{F_i'} - \frac{F_i}{F_i'} + \Phi_i\right) \quad \text{(Equation 19)}$$
$$= \frac{qt^*}{V_p}\left(\frac{1 - F_i}{F_i'} + \Phi_i\right)$$

Equation 19 can further be expressed as $$E_V(t_i) = \frac{qt_i}{V_p}(1 - F_i + F_i'\Phi_i) \quad \text{(Equation 20)}$$
$$= t_D((1 - F_i + F_i'\Phi_i)$$

F can be written as a general function of $\Phi_i$ in the following form $$F_i = (\Phi_i)^{1/n} \quad \text{(Equation 21)}$$

where n≥0. Combining Equations 20 and 21 results in $$E_V(t_i) = t_D\left[1 - \Phi^{\frac{1}{n}}\left(1 - \frac{1}{n}\right)\right] \quad \text{(Equation 22)}$$

Furthermore, the Lorenz Coefficient, $L_C$, of Equation 8 can be written as $$L_C = 2\left[\int_0^1 F d\Phi - 0.5\right] \quad \text{(Equation 23)}$$
$$= 2\left[\int_0^1 \Phi^{\frac{1}{n}} d\Phi - 0.5\right]$$
$$= \frac{n-1}{n+2}$$

$$n = \frac{1 + L_C}{1 - L_C} \quad \text{(Equation 24)}$$

Therefore, Equation 22 and can be written as a function of the Lorenz Coefficient, $L_C$:

$$E_V(t_i) = t_D\left[1 - F\left(\frac{2L_C}{1 + L_C}\right)\right] \quad \text{(Equation 25)}$$

Equation 25 shows that the sweep efficiency equals dimensionless time less the effects of heterogeneity. Furthermore, the volumetric sweep efficiency, $E_V$, is maximized at any dimensionless time, $t_D$, by minimizing the Lorenz coefficient, $L_C$. However, because the total flow rate and pore volume of streamlines are used in calculating the Flow Capacity (F) and Storage Capacity (Φ) in Equation 6, the Lorenz coefficient ($L_C$) does not vary in time for a given flow model. Moreover, the Lorenz coefficient ($L_C$) does not differentiate between heterogeneity in swept zones, which no longer impacts sweep efficiency, and unswept zones that still produce an oil volumetric flow.

As will be described in further detail herein, Flow Capacity (F) and Storage Capacity (Φ) of Equations 6 and 7, respectively, can be redefined to ignore the heterogeneity in the zones already swept by a flooding fluid. Furthermore, displacement heterogeneity in the unswept zones can be minimized using selective well controls.

Figure 4:
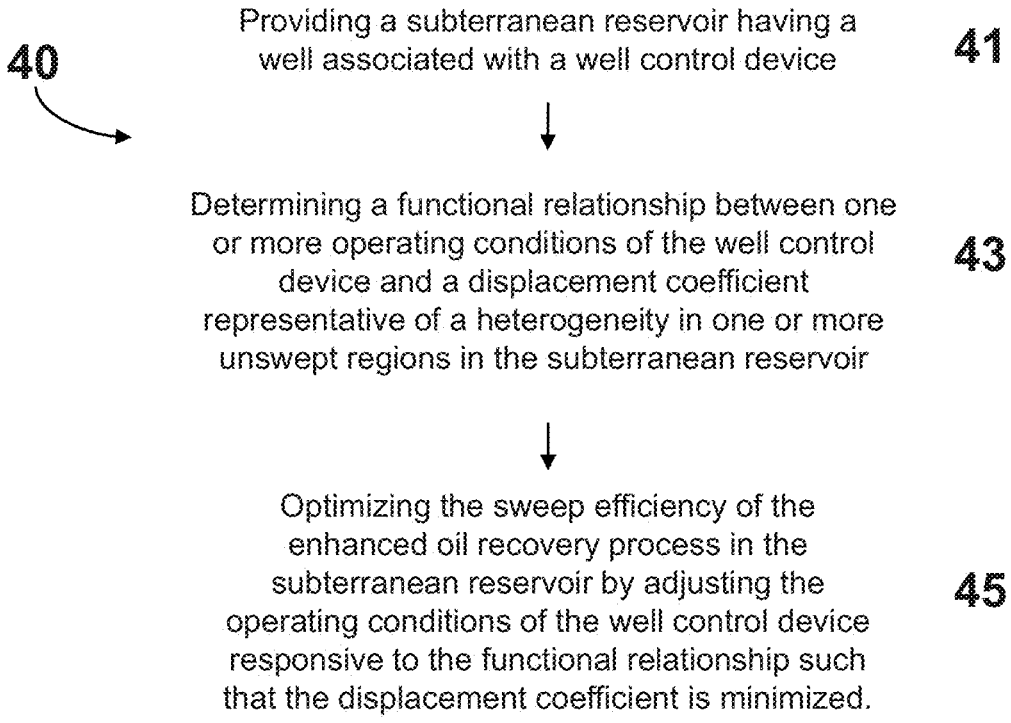
FIG. 4 is a flowchart illustrating steps for enhancing oil recovery from a subterranean reservoir by optimization of sweep efficiency, in accordance with an embodiment of the present invention.

FIG. 4 is a flowchart depicting method 40 for enhancing oil recovery in a subterranean reservoir by optimizing sweep efficiency. In method 40, a subterranean reservoir is provided in step 41. The subterranean reservoir includes at least one well equipped with a well control device. In step 43, a functional relationship between the operating conditions of the well control device and a displacement coefficient is determined. As will be described in greater detail herein, the displacement coefficient is descriptive or representative of heterogeneity in one or more regions in the subterranean reservoir that are unswept by a flooding or injection fluid. In step 45, the sweep efficiency of the enhanced oil recovery process is optimized using the functional relationship determined in step 43. In particular, the displacement coefficient is minimized via adjustments to the well control device operating conditions.

Figure 5:
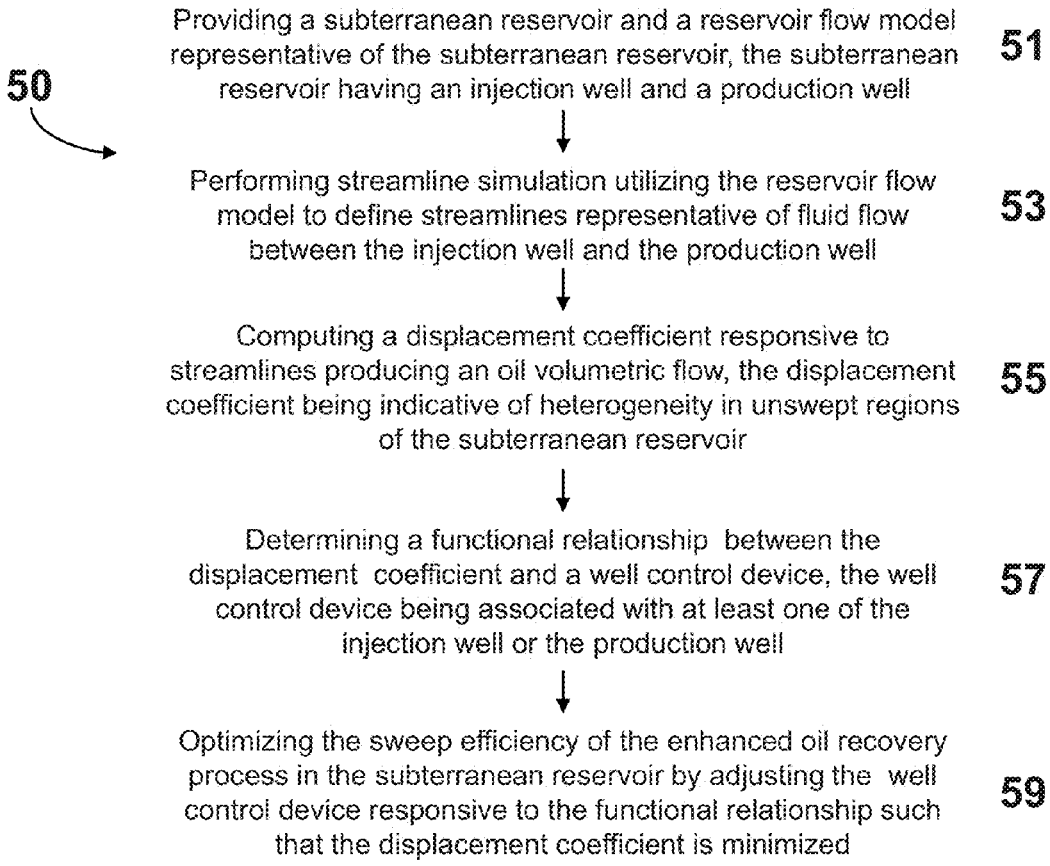
FIG. 5 is a flowchart illustrating steps for enhancing oil recovery from a subterranean reservoir by optimization of sweep efficiency, in accordance with an embodiment of the present invention.

FIG. 5 is a flowchart depicting method 50 for enhancing oil recovery in a subterranean reservoir by optimizing sweep efficiency. In method 50, a subterranean reservoir and a reservoir flow model representative of the subterranean reservoir are provided in step 51. The subterranean reservoir has at least one injection and production well. Streamline simulation of the reservoir flow model is performed in step 53 to define streamlines representative of fluid flow between the injection well and the production well. In step 55, a displacement coefficient, which is indicative of heterogeneity in unswept regions of the subterranean reservoir, is computed responsive to streamlines producing an oil volumetric flow. In step 57, a functional relationship between the displacement coefficient and a well control device is determined. The well control device is associated with one of the injection or production wells. In step 59, the sweep efficiency of the enhanced oil recovery process is optimized using the functional relationship determined in step 57. In particular, the displacement coefficient is minimized via adjustments to the well control device operating conditions.

In one or more embodiments of methods 40 and 50, variations in operation of the well control device can be analyzed by first identifying allowable minima and maxima of the well control device such as, but not limited to, bottomhole pressures, injection rates, and voidage replacement ratios. Furthermore, if the well control device is associated with an injection well, each value can either be identified as a single value or for a specified zone, such as a sand penetrated zone. A sensitivity analysis, such as using Design of Experiment (DoE) sampling techniques, can then be employed to quickly evaluate how variations in operation of the well control device, between its allowable minima and maxima, impact the recovery process of the reservoir. In one or more embodiments, the Design of Experiment sampling techniques uses either a folded Blackett-Burman or D-Optimal approach. A DoE series of streamline simulations can be performed. The DoE table can be constructed for the operational ranges of well control device and a series of simulation input decks can be assembled that contain different operational values of the well control device. Each simulation input deck can then be used to perform streamline-based flow simulation of a reservoir flow model. As will be described, the simulation output can be utilized in many ways.

For example, streamline simulation runs of the reservoir flow model, for each simulation input deck, can be used to quickly evaluate how the geology of a reservoir will impact flow, as well as, be used to compute the dynamic or displacement heterogeneity of the subsurface reservoir. By modeling the fluid flow within a reservoir along streamlines, the distribution of flow paths within complex geology can be computed. Furthermore, visual depictions of the fluid flow behavior can be produced to better understand the geology and flow paths of the subsurface reservoir. There are many commercially available products for performing two-dimensional (2D) and three-dimensional (3D) streamline simulations such as FrontSim™ from Schlumberger Limited, which is headquartered in Houston, Tex.

To evaluate the dynamic or displacement heterogeneity of the subsurface reservoir, Flow Capacity (F) and Storage Capacity (Φ) of Equations 6 and 7, respectively, can be redefined on the basis of oil volumetric flow and the unswept oil volume. In particular, by ignoring the heterogeneity in the zones already swept, the displacement heterogeneity in the unswept zones can be evaluated and minimized. These modified curves, which focus on the unswept portions of the reservoir, are called Hydrocarbon $F_{HC}$-$\Phi_{HC}$ curves and are defined as follows:

$$F_{HC,i} = \frac{\sum_{j=1}^{i} q_{HC,j}}{\sum_{j=1}^{N} q_{HC,i}} \quad \text{(Equation 26)}$$

-continued $$\Phi_{HC,i} = \frac{\sum_{j=1}^{i} Vp_{HC,j}}{\sum_{j=1}^{N} Vp_{HC,i}} \quad \text{(Equation 27)}$$

Figure 6:
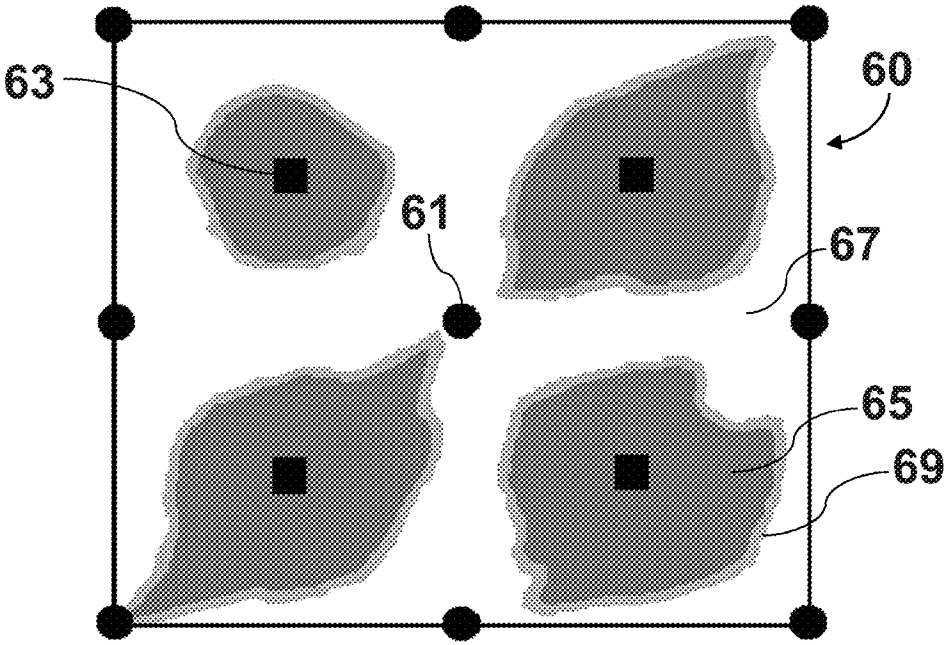
FIG. 6 is an oil saturation map for a heterogeneous reservoir domain, in accordance with an embodiment of the present invention.

FIG. 6 is an oil saturation map for domain 60 of a subterranean reservoir having nine production wells 61 and four injection wells 63. The wells are arranged in a five-spot pattern such that each block of the pattern contains a center production well 61 and four injection wells 63 positioned at each corner of the block. Domain 60 of the subterranean reservoir is naturally divided into swept regions 65 and unswept regions 67, 69. Swept regions 65 of the subterranean reservoir are considered to be fully saturated with an injection fluid such that the saturation tends to change slowly. Unswept regions 67 of the subterranean reservoir are regions free of injection fluid. Unswept regions 69, defining a natural separation between swept regions 65 and unswept regions 67, have been invaded by the saturation front of the injection fluid, but are not yet fully saturated with injection fluid. Typically strong fluid redistribution occurs in unswept regions 69 due to the interactions of fluid flow and heterogeneity in permeability.

By using streamline simulation in one or more embodiments of methods 40 and 50 (FIGS. 4 and 5), heterogeneity in the zones already swept by injection fluid can be ignored such that the displacement heterogeneity in the unswept zones of the reservoir can be evaluated. In particular, heterogeneity in unswept regions 67, 69 are accounted for as all individual streamlines having any amount of oil volumetric flow are used to assemble the Hydrocarbon $F_{HC}$-$\Phi_{HC}$ curves. Accordingly, even if an individual streamline segment only has a 0.001 saturation of oil, it is still used to compute displacement heterogeneity. The term unswept region is therefore defined herein to be any portion of reservoir in which a streamline traversing therethrough produces an oil volumetric flow. By defining $F_{HC}$-$\Phi_{HC}$ curves on the basis of unswept oil volume, methods 40, 50 are applicable in very complex reservoir geologies being highly heterogeneous and having non-unit mobility ratios where fingering and selective flow paths are common.

A Hydrocarbon Lorenz Coefficient, $L_{C\text{-}HC}$, which is a measure of displacement heterogeneity in unswept zones, can be used to optimize volumetric sweep efficiency by minimizing $L_{C\text{-}HC}$ via well controls. The Hydrocarbon Lorenz Coefficient, $L_{C\text{-}HC}$, is defined by:

$$L_{C-HC} = 2\left(\int_0^1 F_{HC}\, d\Phi_{HC} - 0.5\right) \quad \text{(Equation 28)}$$

Because the Hydrocarbon Lorenz Coefficient, $L_{C\text{-}HC}$, is defined on the basis of oil volumetric flow and unswept oil volume, minimizing $L_{C\text{-}HC}$ is mathematically equivalent to maximizing volumetric sweep efficiency, $E_V$. In particular, the slope distribution of the hydrocarbon $F_{HC}$-$\Phi_{HC}$ curve ($dF_{HC}/d\Phi_{HC}$) is minimized through minimization of the Hydrocarbon Lorenz Coefficient, $L_{C\text{-}HC}$.

An example of the functional relationship in steps 43 and 57 of methods 40 and 50, respectively, includes a relationship between the operating conditions of one or more well control devices and the Hydrocarbon Lorenz Coefficient, $L_{C\text{-}HC}$. For example, the Hydrocarbon Lorenz Coefficient, $L_{C\text{-}HC}$, can be described as a function of bottomhole pressures, injection rates, voidage replacement ratio, time, and saturation. Note that because $L_{C-HC}$ is a function of saturation and time, watering out (very high water cut) of a layer changes the description of dynamic heterogeneity for the unswept region. Once a functional relationship has been determined, the volumetric sweep efficiency, $E_V$, of the enhanced oil recovery process can be optimized in step 45 or 59. For example, optimization can be performed by minimizing the Hydrocarbon Lorenz Coefficient, $L_{C-HC}$, via adjustments to the well control device operating conditions. A sensitivity analysis can identify operating conditions that result in the minimum value of the Hydrocarbon Lorenz Coefficient, $L_{C-HC}$. For example, the sensitivity analysis can be performed using Microsoft Office Excel, distributed by Microsoft Corporation headquartered in Redmond, Wash.

In one or more embodiments of methods 40 and 50, the Hydrocarbon Lorenz Coefficient, $L_{C-HC}$, is described as a function of well operating conditions using response surface methodology (RSM). In particular, experimental or simulation results produced from performing a sensitivity analysis, such as a design of experiments, can be investigated by fitting the results on a response surface. Accordingly, a response surface is a representation or model of a real system or its simulation. The response surface is typically an analytical or a simple numerical function which is inexpensive to sample. It can be used as a proxy to a full simulation study to quantify sensitivity of one or more dependent variables in terms of independent variables of interest. For example, flowing bottomhole pressures and completion injection rates can be used to construct a response surface for quantifying the sensitivity of the Hydrocarbon Lorenz Coefficient, $L_{C-HC}$, in terms of the well controls. The Hydrocarbon Lorenz Coefficient, $L_{C-HC}$, can then be minimized using an optimization algorithm. An example of an optimization algorithm is a generalized reduced-gradient algorithm. The operating conditions corresponding to the minimum Hydrocarbon Lorenz Coefficient, $L_{C-HC}$, can then be fed back into the simulator as "optimized" conditions or used in the field to optimize reservoir management.

Methods 40, 50 are a practical and efficient approach for optimization of a recovery process, such as waterflooding. Moreover, methods 40, 50 also can be utilized at any arbitrary time regardless of recovery history. A full-field optimization of volumetric sweep efficiency, even with large reservoir models, can easily be performed by minimizing the displacement heterogeneity in unswept regions of the subterranean reservoir. The Hydrocarbon Lorenz Coefficient, $L_{C-HC}$, is an example of a robust measure of displacement heterogeneity in unswept regions of the reservoir. Other measures of dynamic heterogeneity can also be utilized in methods 40, 50 for maximizing sweep efficiency, such as those disclosed in U.S. patent application Ser. No. 12/637,898, titled "System and method for evaluating dynamic heterogeneity in earth models" filed Dec. 15, 2009, which is incorporated herein by reference.

In one or more embodiments of methods 40 and 50, volumetric sweep efficiency is optimized using streamlines. A one-dimensional (1D) implicit pressure, explicit saturation (IMPES) formulation can be used to perform transport calculations for each streamline, which makes this method fast compared to finite difference simulation. In addition to the given speed advantage of streamline simulation, only a few time steps are required to attenuate pressure transients and output the time of flight (TOF) of the streamlines, $\tau_i$, and their volumetric hydrocarbon flow rate, $q_i$, which subsequently can be used to compute the Hydrocarbon Lorenz Coefficient, $L_{C-HC}$. Because only a few time steps are required with a streamline simulator for optimization, multi-million cell models can be optimized in minutes. Methods 40 and 50 are designed to optimize sweep efficiency at the field scale, but could also be used to optimize operations on a sector or pattern basis if desired.

Figure 7:
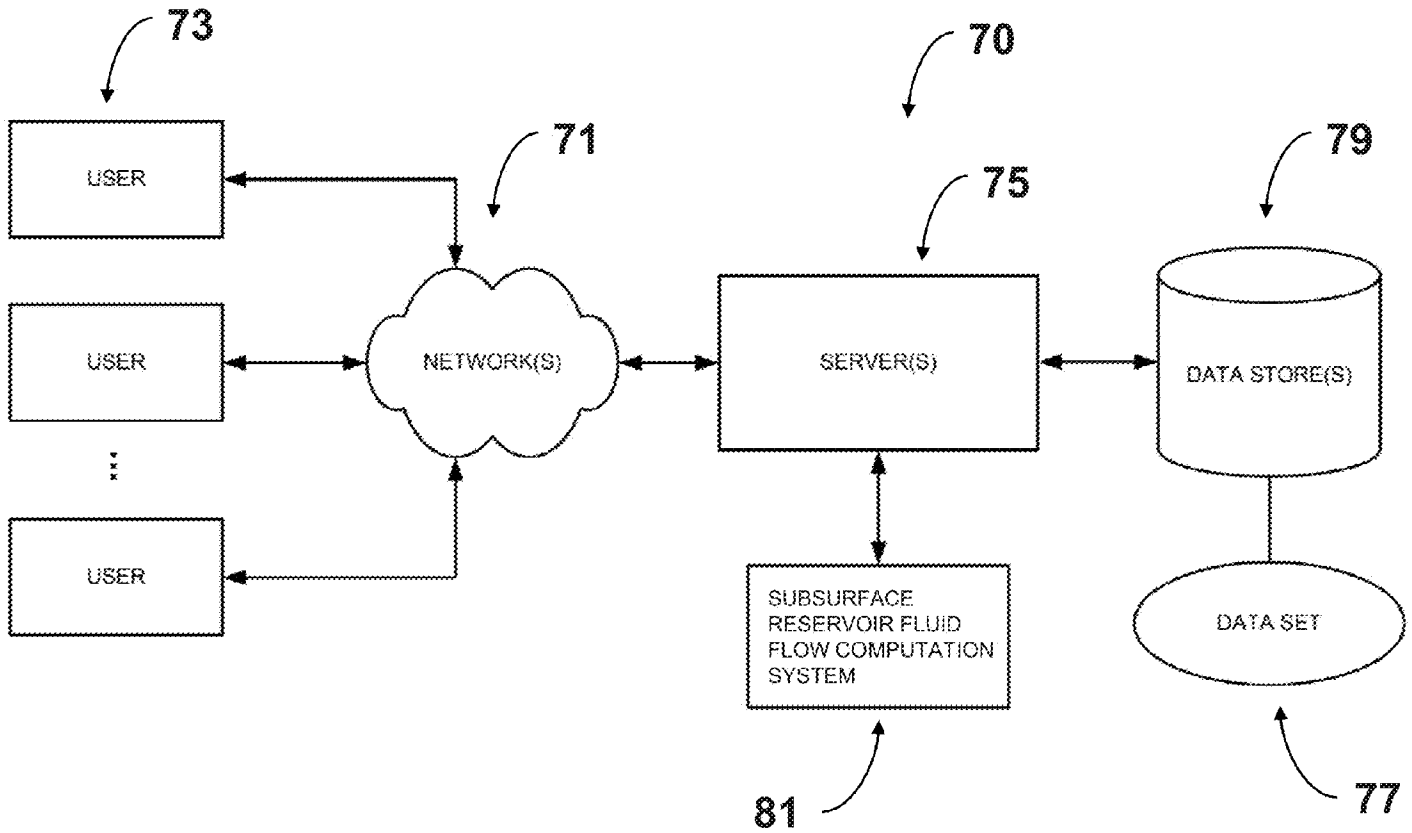
FIG. 7 is a schematic illustrating a system for enhancing oil recovery from a subterranean reservoir by optimization of sweep efficiency, in accordance with an embodiment of the present invention.

Methods 40, 50 may be implemented on various types of computer architectures, such as for example on a single general purpose computer or workstation, on a networked system, in a client-server configuration, in an application service provider configuration, or a combination thereof. An exemplary computer system 70 suitable for implementing the methods disclosed herein is illustrated in FIG. 7. As shown in FIG. 7, the computer system 70 to implement one or more methods and systems disclosed herein can be linked to a network 71. As an example, the network 71 can be part of a local area network to other, local computer systems and/or part of a wide area network, such as the Internet, that is connected to other, remote computer systems. Accordingly, one or more users 73 can access computer system 70 via network 71. Additionally, the methods and systems described herein may be implemented on many different types of processing devices or servers 75 by program code including program instructions that are executable by the device processing subsystem. The software program instructions may include source code, object code, machine code, or any other stored data that is operable to cause a processing system to perform the methods and operations described herein. As an illustration, a computer can be programmed with instructions to perform the various steps of the flowcharts shown in FIGS. 4 and 5.

It is further noted that the systems and methods may include data signals conveyed via networks (e.g., local area network, wide area network, internet, combinations thereof), fiber optic medium, carrier waves, wireless networks, and combinations thereof for communication with one or more data processing devices. The data signals can carry any or all of the data disclosed herein that is provided to or from a device.

The systems' and methods' data 77 (e.g., associations, mappings, data input, data output, intermediate data results, final data results) may be stored and implemented in one or more different types of computer-implemented data stores 79, such as different types of storage devices and programming constructs (e.g., RAM, ROM, Flash memory, flat files, databases, programming data structures, programming variables, IF-THEN (or similar type) statement constructs). It is noted that data structures describe formats for use in organizing and storing data in databases, programs, memory, or other computer-readable media for use by a computer program. As an illustration, a system and method can be configured with one or more data structures resident in a memory for storing data 77 representing reservoir properties, well conditions and operating parameters, Design of Experiment tables, response surfaces, hydrocarbon flow capacity—storage capacity curves, and displacement coefficients such as the Hydrocarbon Lorenz Coefficient. Software instructions (executing on one or more data processors) can access the data 77 stored in the data structure for generating the results described herein).

An embodiment of the present disclosure provides a computer-readable medium storing a computer program executable by a computer for performing the steps of any of the methods disclosed herein. A computer program product can be provided for use in conjunction with a computer having one or more memory units and one or more processor units, the computer program product including a computer readable storage medium having a computer program mechanism encoded thereon, wherein the computer program mechanism can be loaded into the one or more memory units of the computer and cause the one or more processor units of the computer system 70 to execute various steps illustrated in the flow charts of FIGS. 4 and 5. In particular, subsurface reservoir fluid flow computation system 81 can interact with computer system 70 for performing steps of methods 40, 50 such as using DoE sampling techniques, constructing a response surface, performing streamline simulations, and running optimizations.

The computer components, software modules, functions, data stores and data structures described herein may be connected directly or indirectly to each other in order to allow the flow of data needed for their operations. It is also noted that a module or processor includes but is not limited to a unit of code that performs a software operation, and can be implemented for example as a subroutine unit of code, or as a software function unit of code, or as an object (as in an object-oriented paradigm), or as an applet, or in a computer script language, or as another type of computer code. The software components and/or functionality may be located on a single computer or distributed across multiple computers depending upon the situation at hand.

Example I

Figure 8:
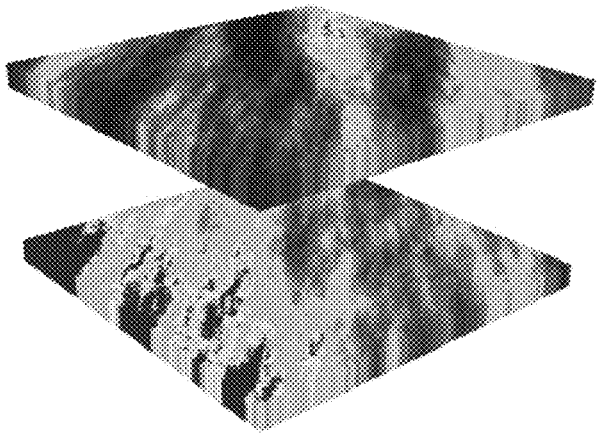
FIG. 8A shows two simulation layers for a permeability field of a reservoir flow model, in accordance with an embodiment of the present invention.
FIG. 8B shows the location of injection and production wells in a reservoir flow model, in accordance with an embodiment of the present invention.
Figure 8:
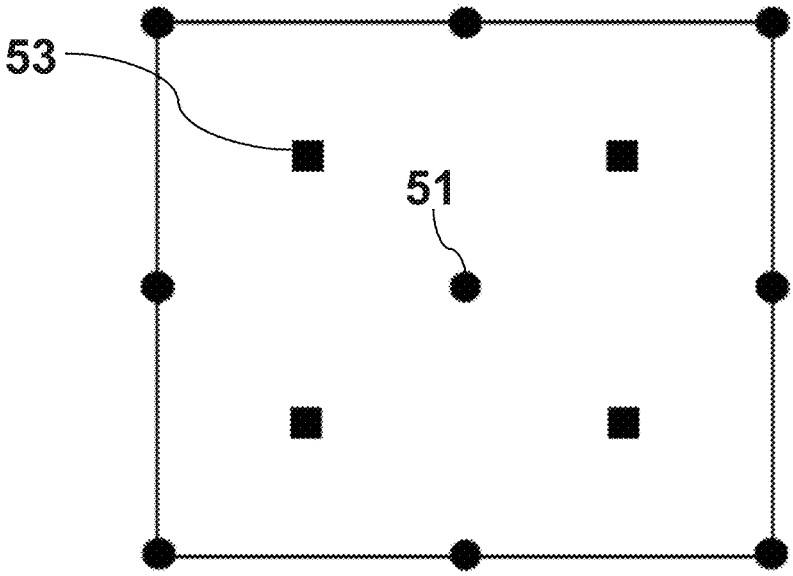

FIG. 8A shows two simulation layers for a permeability field of a conceptual reservoir flow model consisting of five different sands. The permeability field was created with non-sequential Gaussian simulation. The permeability values range from 0.1 to 523 millidarcies (mD), with a mean of 50 mD and a standard deviation corresponding to a Dykstra-Parsons coefficient of 0.6. Permeability was log-normally populated with the dimensionless correlation lengths provided in Table 1 below. Horizontal permeability was assumed to be isotropic and having a vertical to horizontal permeability ratio of 0.1 ($k_v/k_h$=0.1). Porosity was populated from the permeability field and random noise was added such that the porosity-permeability relationship was more realistic. Other parameters of the model are also summarized below in Table 1.

TABLE 1

Model Parameters

| | | | |
|---|---|---|---|
| Grid | 101 × 101 × 10 | P-P spacing, ft** | 1300 |
| Grid size, ft | 26, 26, 5 | P-I spacing, ft** | 919 |
| Datum, ft | 3300 | $\mu_o$ (@datum), cp | 2 |
| $P_{initial}$, psi | 1485 | $R_s$, scf/rb | 200 |
| $Ø_{avg}$ | 0.21 | $\beta_o$, rb/stb | 1.15 |
| $k_{x,\,avg}$, mD* | 50 | $\beta_w$, rb/stb | 1.01 |
| $k_{y,\,avg}$, mD* | 50 | $\rho_o$, ° API | 56 |
| $k_{z,\,avg}$, mD* | 50 | $c_t$, 1/psi | 3.0E−06 |
| $\lambda_{x/L}$ | 5 | $c_o$, 1/psi | 5.0E−06 |
| $\lambda_{y/L}$ | 1 | $c_w$, 1/psi | 1.0E−06 |
| $\lambda_{z/n}$ | 0.30 | $P_b$, psi | 250 |
| $S_{or}$ | 0.2 | WOC, ft | 4000 |
| M | 1 | GOC, ft | 2000 |
| | | $S_{wir}$ | 0.2 |

*permeability is log-normally distributed

**P-P: producer-producer, P-I: producer-injector

FIG. 8B shows the location of the injection and production wells in the conceptual reservoir flow model. The wells are arranged in a five-spot pattern such that each block of the pattern contains a center production well 53 and four injection wells 51 positioned at each corner of the pattern block. Injection and production wells are completed in all layers and are simulated with a simple geometric flow allocation pattern. In particular, the injection wells are constrained with a rate of 1050 reservoir barrels per day (RB/D) and the production wells are set to operate a constant flowing bottomhole pressure of 700 pounds per square inch (psi). Each injection well is equipped with inflow completion valves (ICVs) so that the amount of injection fluid allocated to each sand layer can be controlled. Accordingly, individual injection well rates, the fraction of these injection well rates allocated to each layer, and the flowing bottomhole pressures of production wells are the operational conditions controlled in this example. Table 2 summarizes the allowable operating condition limits and total field injection rate:

TABLE 2

Operating Condition Limits

| | |
|---|---|
| Min. Inj. rate of each ICV, STB/D | 75 |
| Max. Inj. rate of each ICV, STB/D | 300 |
| Total Field Injection Rate, rB/D | 4200 |
| Min. BHP of producers, psi | 700 |
| Max. BHP of producers, psi | 800 |

Using Methods 40, 50, flow simulations are performed with a commercial streamline reservoir simulator to optimize the volumetric sweep efficiency. In a first simulation, optimization is performed from the beginning of the waterflood. In a second simulation, optimization is initiated when the field water cut reaches thirty percent (30%). In a third simulation, optimization is initiated when the field water cut reaches eighty percent (80%).

Figure 9:
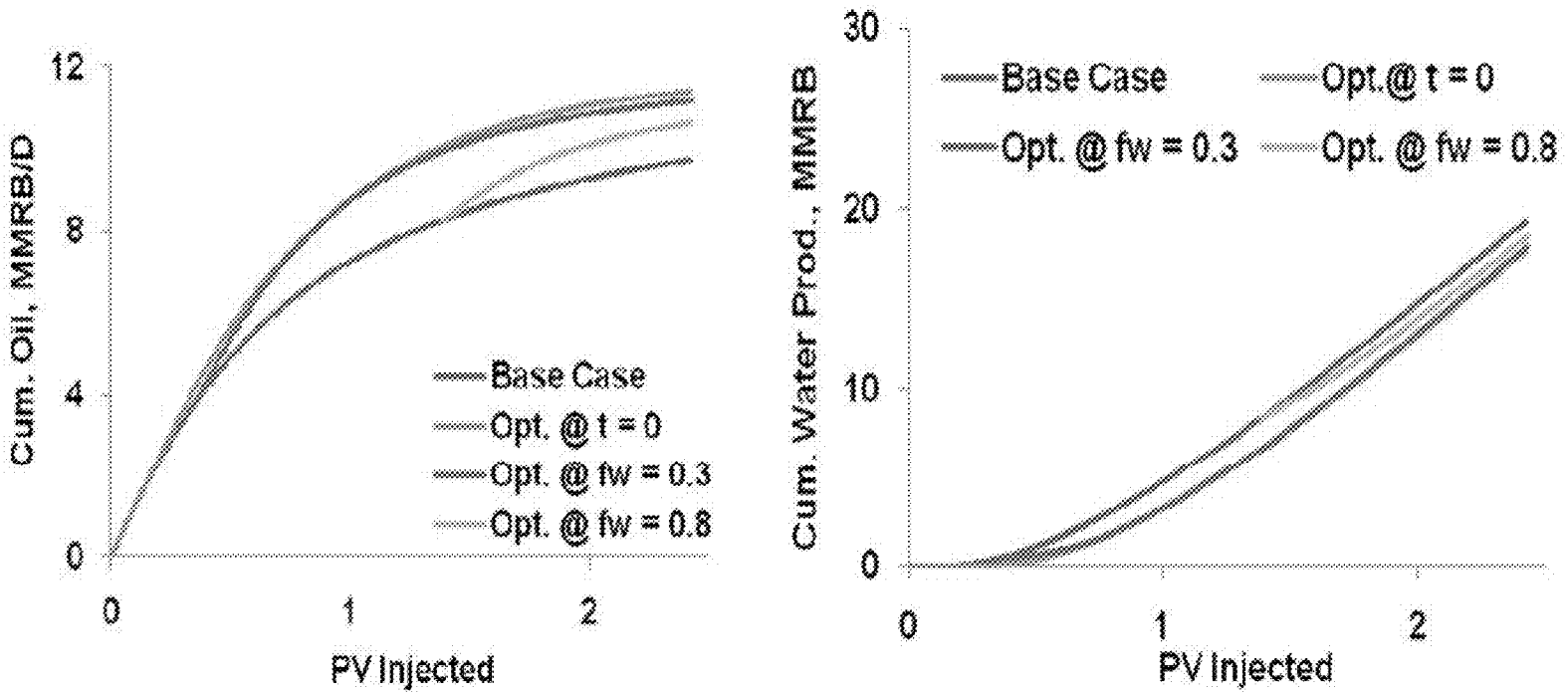
FIG. 9 compares results of three optimized simulation cases in terms of cumulative oil and produced water, in accordance with an embodiment of the present invention.

FIG. 9 shows the results of the three optimized simulation cases in terms of cumulative oil and water produced compared to the non-optimized base case. In the first simulation, where optimization starts from the beginning of the waterflood (t=0), an incremental oil recovery of fifteen percent (15%) of Stock Tank Original Oil In Place (STOOIP) is obtained. The results also indicate a twenty-three percent (23%) reduction in water production, thereby drastically reducing water disposal costs. The second and third simulations, which start optimization at a field water cut of 30% and 80%, respectively, also show significant improvement in volumetric sweep. In both of the second and third simulations, instantaneous improvements in flood performance can be observed. This demonstrates the ability of Methods 40, 50 to improve sweep efficiency even after water breakthrough.

Figure 10:
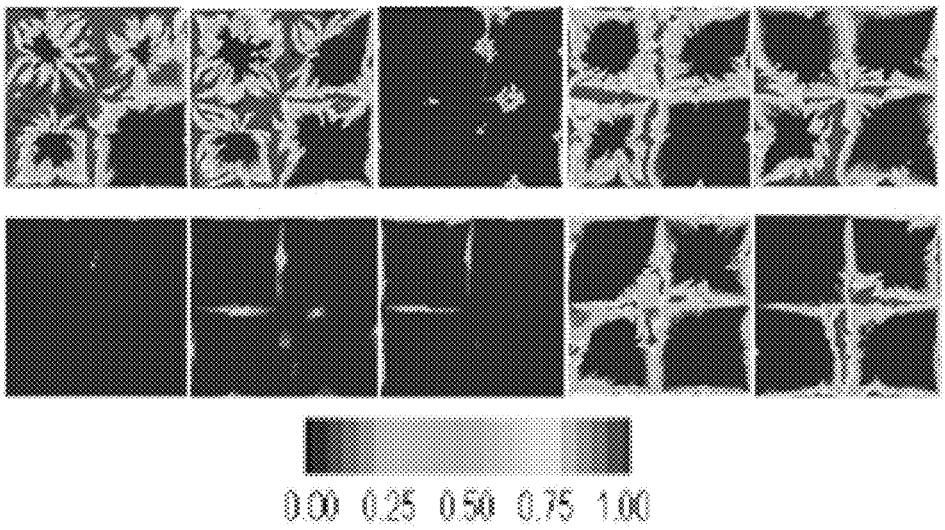
FIG. 10A shows saturation maps for a reservoir flow model.
FIG. 10B shows saturation maps of a reservoir flow model obtained using an optimization method, in accordance with an embodiment of the present invention.
Figure 10:
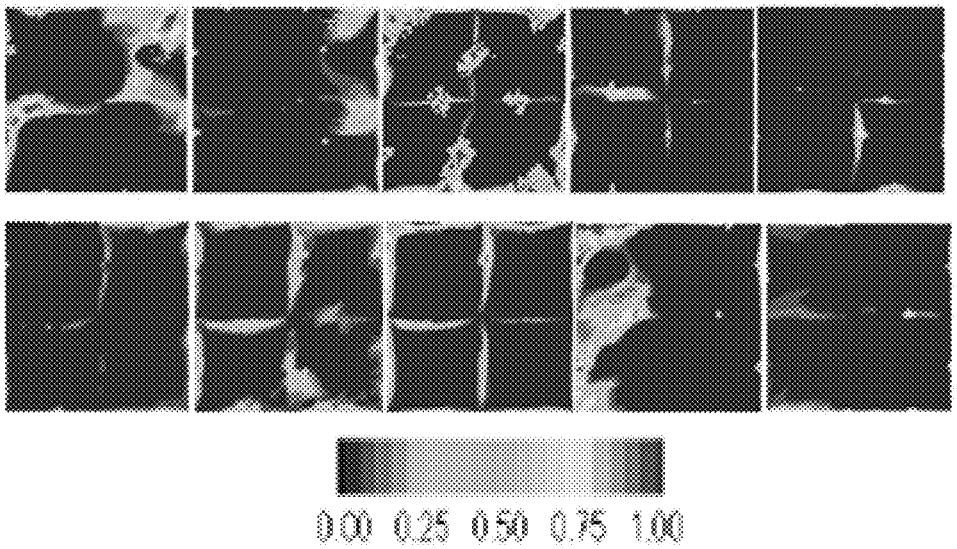

FIGS. 10A and 10B compare saturation maps for the non-optimized base case (10A) and the first simulation case where optimization started at the beginning of the waterflood (10B). In particular, the saturation maps are end-of-simulation maps with about three pore volumes of fluid injected. In FIGS. 10A and 10B, the top layer of the reservoir is shown in the upper left and the bottom layer of the reservoir is in the lower right. As can be observed in FIGS. 10A and 10B, the unswept area of the reservoir is greatly reduced in the optimized case. In particular, optimization results in incremental oil of 15% of STOOIP.

Figure 11:
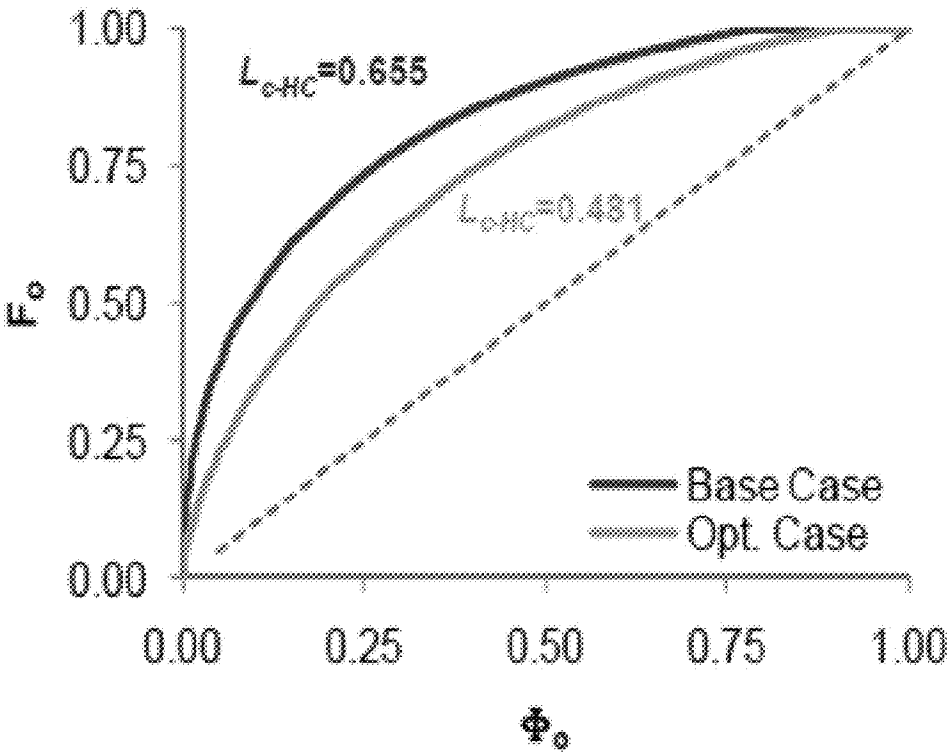
FIG. 11 illustrates Hydrocarbon Flow Capacity-Storage Capacity ($F_{HC}$-$\Phi_{HC}$) curves, in accordance with an embodiment of the present invention.

FIG. 11 illustrates hydrocarbon flow capacity—storage capacity ($F_{HC}$-$\Phi_{HC}$) curves for the non-optimized base case and the second optimized simulation case beginning at 30% field watercut. This illustrates that Methods 40, 50 result in a more uniform displacement of "unswept" oil, as the $F_{HC}$-$\Phi_{HC}$ curve for the optimized case produces a $F_{HC}$-$\Phi_{HC}$ curve with a more uniform slope. Accordingly, the Hydrocarbon Lorenz Coefficient, $L_{C\text{-}HC}$, for the optimized simulation case also has a lower value of 0.481 compared to the non-optimized base case of 0.655.

Figure 12:
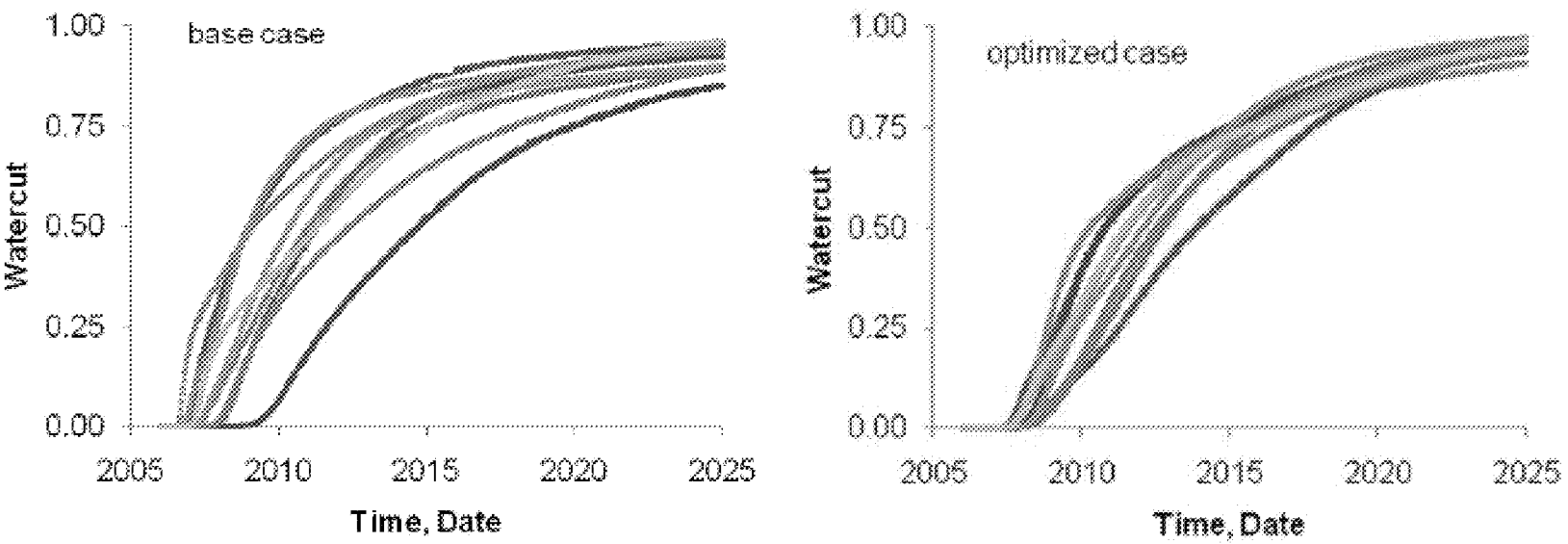
FIG. 12 compares field watercuts for a reservoir flow model using a non-optimized simulation method and an optimized simulation method, in accordance with an embodiment of the present invention.

FIG. 12 compares field watercuts for the non-optimized case (left) and the optimized simulation case using Methods 40, 50 (right). The improved watercut responses of production wells can be observed. Methods 40, 50 not only equalize breakthough times, but also results in a similar evolution of watercut curves for all wells.

Therefore, while the above example is artificial and small in scale, it nevertheless illustrates the advantages of Methods 40, 50. Five-hundred streamline simulations runs, obtained using a Design of Experiment sampling technique, were performed in approximately three hours using a model grid size of $10^5$. Methods 40, 50 result in nearly instantaneous sweep efficiency improvements, thus increasing cumulative oil recovery and also significantly reducing water production. Furthermore, Methods 40, 50 can start optimization at any arbitrary time, regardless of whether water breakthrough has occurred.

Example II

Figure 13:
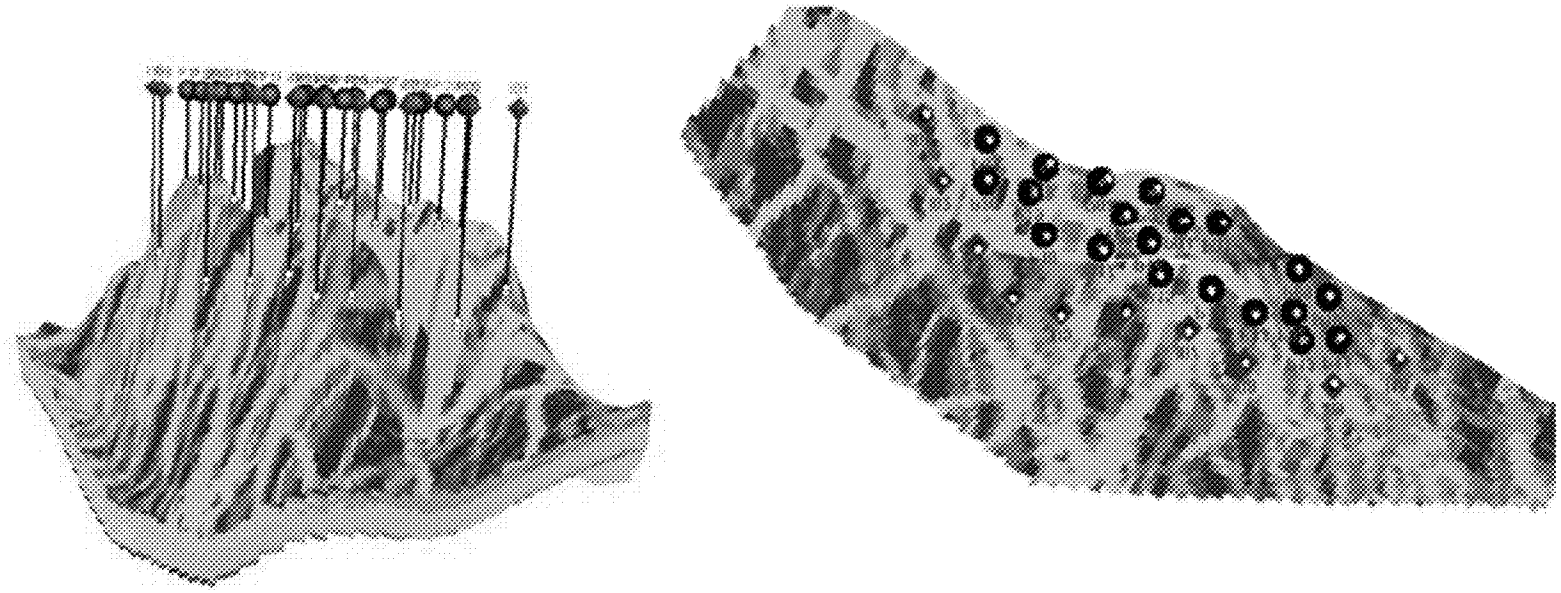
FIG. 13 illustrates three-dimensional views of a reservoir model of Brugge Field showing the injection and production well locations, in accordance with an embodiment of the present invention.
Figure 14:
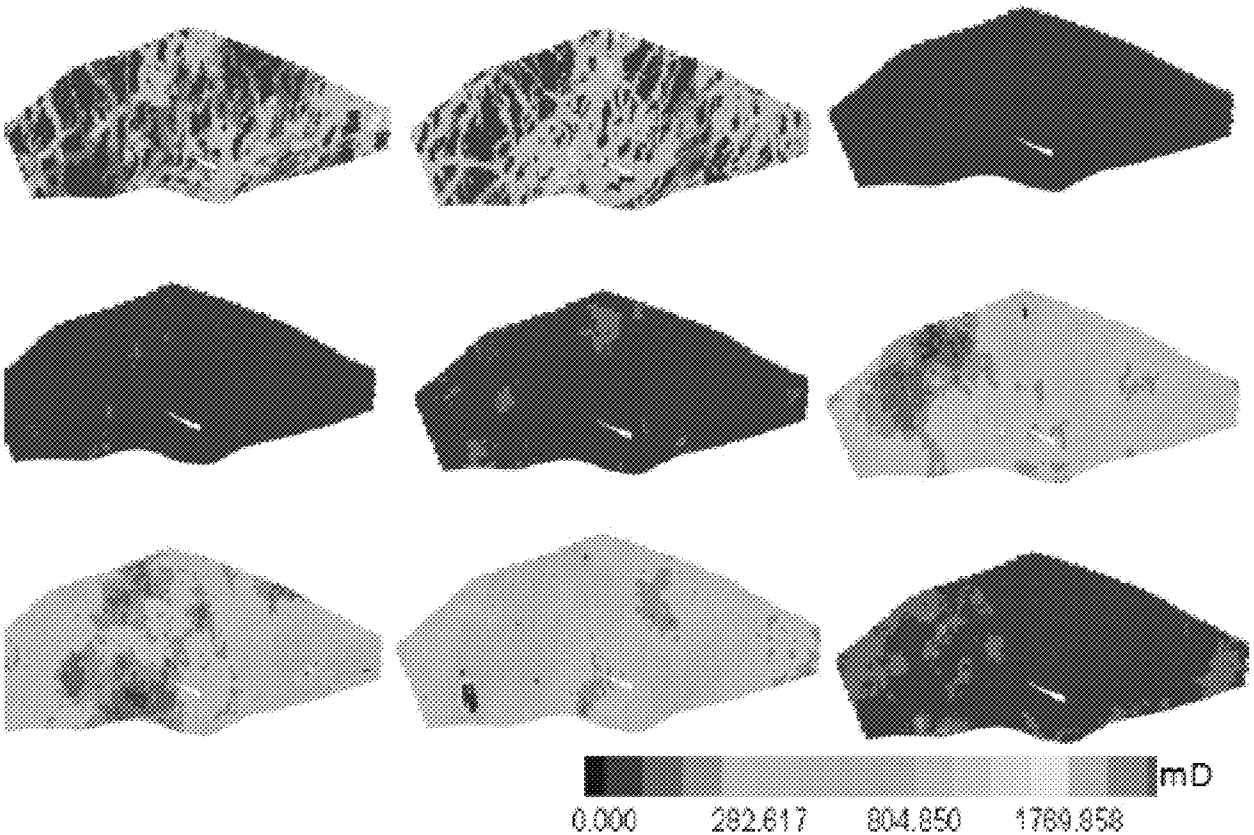
FIG. 14 illustrates three-dimensional views of a reservoir model of Brugge Field showing the horizontal permeability field of reservoir zones, in accordance with an embodiment of the present invention.

FIGS. 13 and 14 are three-dimensional views of a reservoir model of Brugge Field. In particular, FIG. 13 shows the locations of wells in Brugge Field and FIG. 14 shows the horizontal permeability field of its reservoir zones. Details of Brugge Field are taken from a Society of Petroleum Engineers (SPE) comparative study, which was held in June 2008 to benchmark the use of history matching and flood optimization methods. In particular, a three-dimensional synthetic dataset was constructed consisting of 104 upscaled realizations of a 3D geological model, well-log data from wells with fixed positions, ten years of the production history, inverted time-lapse seismic data in terms of (uncertain) pressures and saturations, and economic parameters for oil and water (price and discount rate). Previous results of this study and a variety of techniques used by competitors are reported in SPE Paper No. 119094.

The structure of Brugge Field consists of an E-W elongated half-dome with a large boundary fault at its northern edge (NBF), and one internal fault with a modest throw at an angle of about twenty (20) degrees to the NBF. The dimensions of the field are roughly 33,000×9,800×200 feet. As presented below in Table 3, Brugge Field consists of four reservoir zones, namely Schelde, Maas, Waal and Schie. The properties and thickness of the reservoir zones are typical for a North Sea Brent-type field. There is no continuous shale barrier between different reservoir zones.

TABLE 3

Reservoir zones of Brugge field

| Formation | h, ft | Ø, fraction | k, mD | N/G, % | Depositional Env. | Remarks |
|---|---|---|---|---|---|---|
| Schelde | 32.8 | 0.207 | 1105 | 60 | Fluvial | Discrete sand bodies in shale |
| Waal | 85.3 | 0.190 | 90 | 88 | Lower shoreface | Contains loggers: carbonate concretions |
| Maas | 65.6 | 0.241 | 814 | 97 | Upper shoreface | |
| Schle | 16.4 | 0.194 | 36 | 77 | Sandy shelf | Irregular carbonate patches |

Brugge field is developed with twenty (20) production wells and ten (10) injection wells, all of which are vertically oriented. The injection wells are completed through all simulation layers; hence through all four reservoir zones. Production wells are completed in Schelde, Mass, and Waal reservoir zones. A summary of the well completions is provided below in Table 4.

TABLE 4

Brugge field well completions

| Wells | Top Comp. | Middle Comp. | Bottom Comp. |
|---|---|---|---|
| Injectors | Layers 1-2 (Schelde) | Layers 3-5 (Maas) | Layers 6-9 (Waal-Schie) |
| P1, P2, P3, P4, P6, P7, P8, P11, P12, P13, P16, P17, P18, P19, P20 | Layers 1-2 (Schelde) | Layers 3-5 (Maas) | Layers 6-8 (Waal) |
| P5, P10, P14, P15 | Layers 1-2 (Schelde) | Layers 3-5 (Mass) | |
| P9 | Layers 1-2 (Schelde) | Layers 3-5 (Maas) | |

For optimization purposes, each well includes multiple completions that can be individually controlled. The completions correspond to the different reservoir zones. In the first ten years of production, the field was produced without individually controlled completions. The injection wells are constrained by the water injection rate, while the production wells are constraint by fluid production rate. Optimization begins at the end of the ten year production period, which corresponds to the reservoir being under a peripheral waterflood for about eight years. Optimization is directed to maximizing the net present value (NPV) at the end of the thirty year period. As will be described, Brugge field is used to illustrate the effectiveness of Methods 40, 50 in optimizing sweep efficiency in the reservoir. Only one realization from the initial ensemble of realizations and history matched models provided in the comparative study is used in this example. Hence, one skilled in the art will recognize that the optimization results presented herein are not comparable with the competition results in described in SPE Paper No. 119094.

Figure 15:
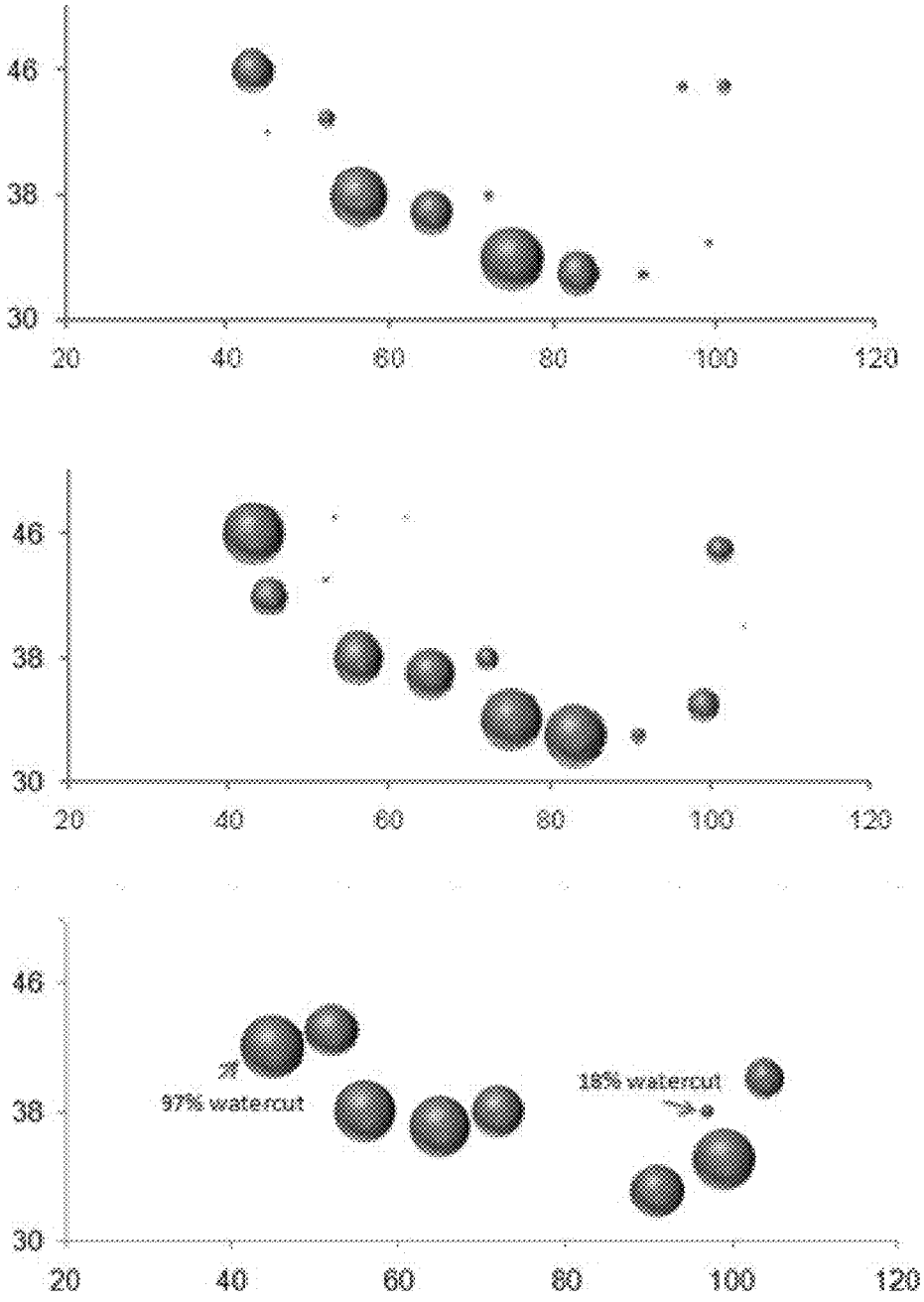
FIG. 15 illustrates watercut bubble maps for each reservoir zone of Brugge Field, in accordance with an embodiment of the present invention.

FIG. 15 illustrates watercut bubble maps for each reservoir zone. This figure shows that some of the production wells close to the injection wells have high watercut, the maximum being 97% for P20. Additionally, nine of the twenty high watercut completions are in the bottom zone, suggesting that this zone significantly contributes to the total field watercut. Both areal and vertical variability of the watercuts suggest that the field has been operated under sub-optimal conditions.

In simulation of the base case, the following operating conditions are used. For each injection well, the maximum injection rate is 4,000 RB/D and the maximum allowable bottomhole injection pressure is 2,611 psi. For each production well, the maximum production rate is 3,000 RB/D and the minimum allowable bottomhole flowing pressure is 725 psi. Completions producing above 94% watercut are shut in. For layer 2, completions are shut in at 92% watercut.

Methods 40, 50 are used to determine optimized well operating conditions that result in sweeping the remaining oil efficiently. Each injection well is equipped with an inflow completion valve (ICV) with such that the amount of injection to each sand layer can be controlled. The allowable operating condition limits and total field injection are the same as the base case. Injection rates and the fraction of these rates allocated to each layer, and flowing bottomhole pressure of production wells are considered to be the operation conditions that can be controlled. A D-Optimal approach to Design of Experiment, which creates an optimal set of experiments by maximizing the determinant of the design matrix, is used to construct a table of 3655 streamline simulation input decks.

Streamline simulations are performed for each input deck and a fieldwide Hydrocarbon Lorenz Coefficient, $L_{C\text{-}HC}$, is calculated for each case. A response surface for the Hydrocarbon Lorenz Coefficient, $L_{C\text{-}HC}$, is constructed using least square linear regression. Once the response surface for the Hydrocarbon Lorenz Coefficient, $L_{C\text{-}HC}$, is constructed, the operating conditions that minimize the $L_{C\text{-}HC}$ are searched for on this response surface using a constrained nonlinear optimization. Finally, the reservoir flow model is simulated with the optimal conditions for two years. Within the two year period, if any of the completions violated a maximum watercut of 94%, the well was shut-in and the optimization was updated. Optimization of the Brugge Field realization using Methods 40, 50 included eleven total optimization steps, each being approximately a two year interval.

In addition to repeating the optimization when well operations change as described above, optimization can be repeated if the mobility ratio is not unity. This may be needed because Methods 40, 50 assume steady state conditions exist when generating the hydrocarbon flow capacity—storage capacity ($F_{HC}$-$\Phi_{HC}$) curves. Steady state conditions are often preserved with unit mobility ratio and in the absence of drilling and completion activities or strong changes in well operating conditions. However, nonunit mobility ratios and/or the existence of significant buoyancy forces are such conditions that can depart from steady state. Accordingly, optimization can be periodically repeated when imbalanced body forces cause the distribution of the streamlines, connectivity and associated swept areas between injection wells and production wells to change.

Figure 16:
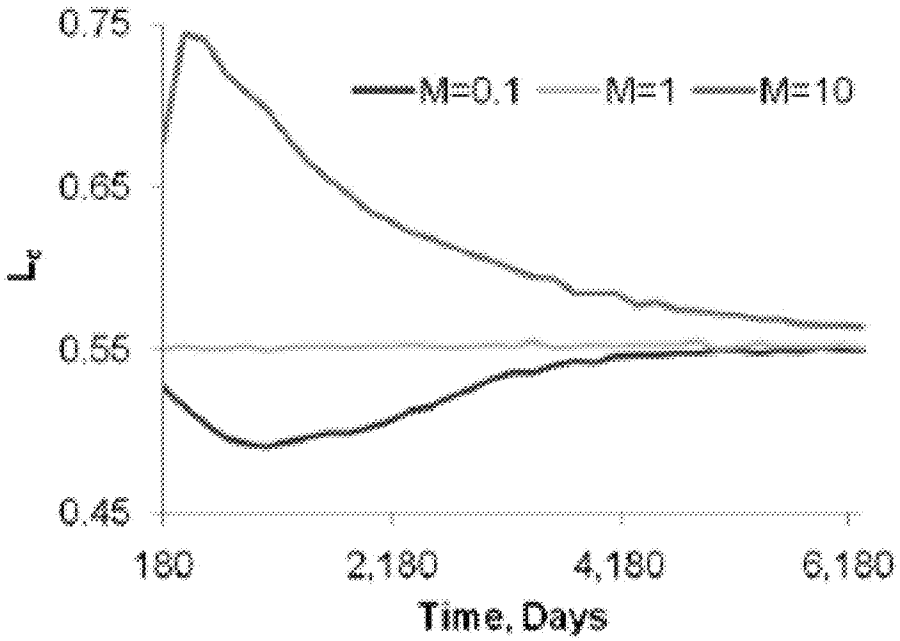
FIG. 16 illustrates the time dependency of the Lorenz Coefficient, $L_C$, for varying end-point mobility ratio scenarios, in accordance with an embodiment of the present invention.

FIG. 16 shows time dependency of the Lorenz Coefficient, $L_C$, (not the Hydrocarbon Lorenz Coefficient, $L_{C\text{-}HC}$) for varying end-point mobility ratio scenarios. FIG. 16 can be used to evaluate how the dynamic heterogeneity changes in time due to body forces. As can be seen in FIG. 16, the only case where the Lorenz Coefficient, $L_C$, stays constant is M=1. This indicates that no optimization update is required when the mobility ratio is unity, except as field conditions change such as wells being shut in due to high watercut. In one or more embodiments, optimization is repeated when the field-wide Lorenz Coefficient, $L_C$, encounters a relative change greater than 10%. For example, the Lorenz Coefficient varies by plus or minus 0.065 from $L_C$=0.65. In one or more embodiments, optimization is repeated when the field-wide Lorenz Coefficient, $L_C$, encounters a relative change greater than 5%. For example, the Lorenz Coefficient varies by plus or minus 0.025 from $L_C$=0.5. The relative change in field-wide Lorenz Coefficient, $L_C$, can be determined by plotting $L_C$ for the existing optimal run. Of course, changing field conditions, including shutting in wells, or infill drilling, also change the flow field and a re-optimization might be required.

Figure 17:
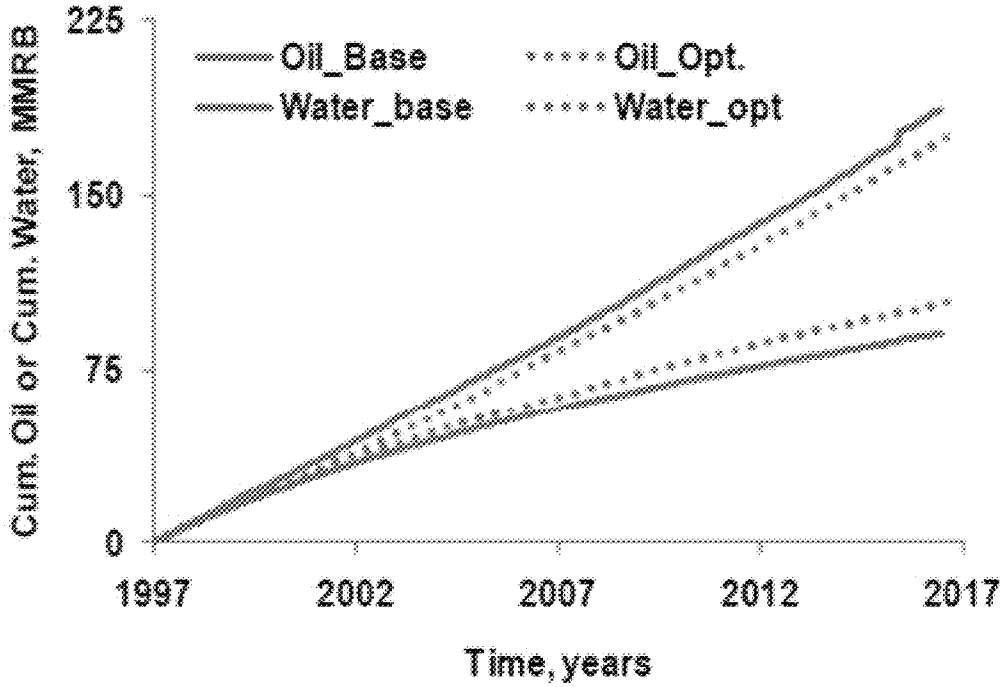
FIG. 17 compares cumulative oil and water production rates for a reservoir model of Brugge Field using a non-optimized simulation method and an optimized simulation method, in accordance with an embodiment of the present invention.

FIG. 17 compares the cumulative oil and water production rates for the base case and optimized case. Optimization using Methods 40, 50 result in a 16% increase in cumulative oil and a 6% reduction in water production compared to the base case. The resulting optimized NPV is $3.78 billion, which is 12% higher than the base case.

Figure 18:
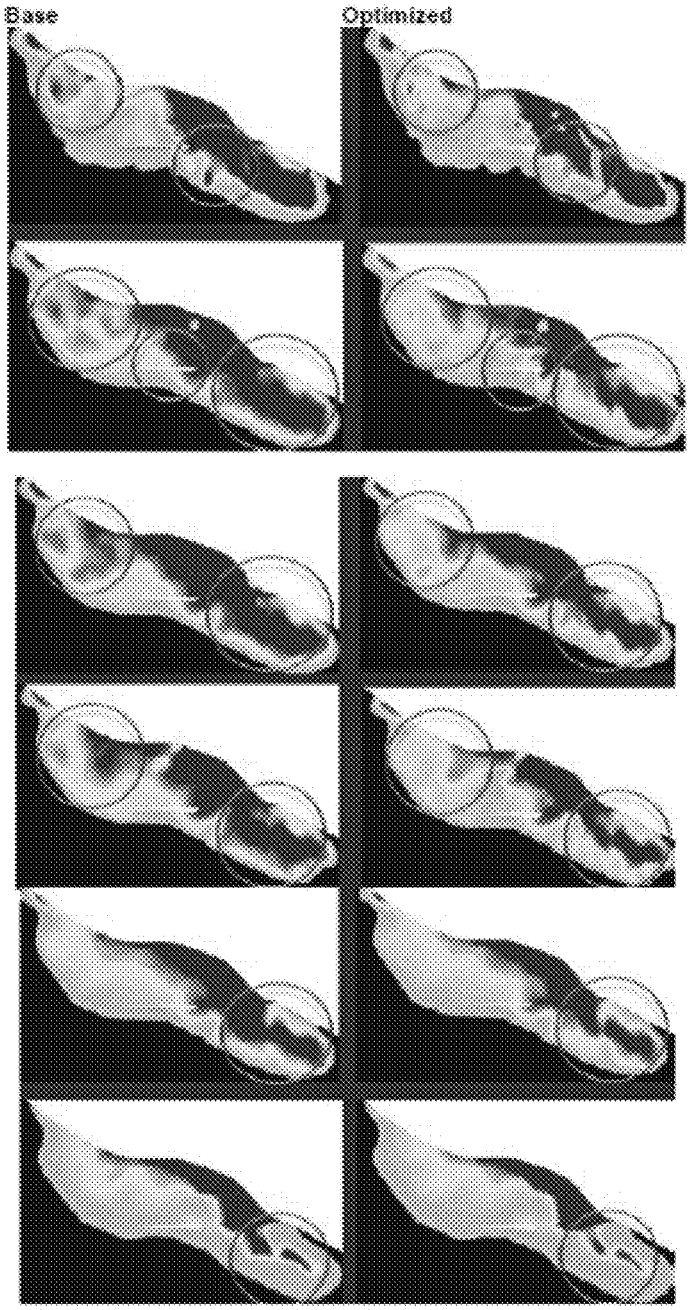
FIG. 18 illustrates oil saturation maps for a reservoir model of Brugge Field using a non-optimized simulation method and an optimized simulation method, in accordance with an embodiment of the present invention.

FIG. 18 illustrates oil saturation maps for the base case compared to the optimization case using Methods 40, 50. The improved sweep efficiency in the optimized case can be observed across the different layers. Areas that have been swept more efficiently compared to the base case are highlighted with circles.

As mentioned previously, Methods 40, 50 are extremely fast such that multi-million cell models can be optimized very quickly. Because Methods 40, 50 utilize pseudo-steady state flow conditions, the streamline simulator can attenuate pressure transients in a few time steps and export streamline volumetric flow rates and time of flight. In about two man hours and twenty-two CPU hours, eighty-four control parameters are optimized, including simulation runs (average 2,700 per optimization step), analysis, and optimization.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention. For example, while the above examples utilized Methods 40, 50 to optimize the sweep efficiency in a waterflood recovery processes, Methods 40, 50 can also be applied to other enhanced oil recovery applications to optimize sweep efficiency. Furthermore, Methods 40, 50 can be used in other recovery processes such as for optimizing thermal sweep in geothermal reservoirs.

Furthermore, it should be understood that as used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise. Finally, as used in the description herein and throughout the claims that follow, the meanings of "and" and "or" include both the conjunctive and disjunctive and may be used interchangeably unless the context expressly dictates otherwise.

NOMENCLATURE f=flow capacity
c=storage capacity
F=cumulative flow capacity
C=cumulative storage capacity
$\Phi$=dynamic storage capacity
$F_{HC}$=dynamic cumulative hydrocarbon flow capacity
$\Phi_{HC}$=dynamic cumulative hydrocarbon storage capacity
q=flow rate, RB/D
k=permeability, mD
h=thickness, ft
Vp=pore volume, ft3
$\tau$=time of flight, 1/D
$L_C$=Dynamic Lorenz coefficient
$L_{C\text{-}HC}$=Dynamic Hydrocarbon Lorenz coefficient
t*=mean residence time, D
l=flow path length, ft
$E_v$=volumetric sweep efficiency
t=time, D
$v_i$=flow path velocity, ft/D

What is claimed is:

1. A method for optimizing sweep efficiency of an enhanced oil recovery process in a subterranean reservoir, the method comprising:

(a) providing a subterranean reservoir having a well associated with a well control device;

(b) determining a functional relationship between an operating condition of the well control device and a displacement coefficient representative of a heterogeneity of an unswept region in the subterranean reservoir wherein determining the functional relationship includes one or more of performing a sensitivity analysis to identify the operating condition of the well control device that impacts the displacement coefficient, and using response surface methodology to represent a sensitivity of the displacement coefficient in terms of the operating condition of the well control device; and (c) optimizing the sweep efficiency of the enhanced oil recovery process in the subterranean reservoir by adjusting the operating condition of the well control device responsive to the functional relationship such that the displacement coefficient is minimized.

2. The method of claim 1, wherein performing the sensitivity analysis comprises using Design of Experiment sampling techniques.

3. The method of claim 1, wherein the functional relationship is represented as a response surface and the response surface is minimized in step (c) to determine an optimal operating condition of the well control device.

4. The method of claim 1, wherein the operating condition of the well control device is selected from the group consisting of a flowing bottomhole pressure, an injection rate, and a voidage replacement ratio.

5. The method of claim 1, wherein determining the functional relationship in step (b) includes computing a flow capacity and storage capacity of the unswept region in the subterranean reservoir.

6. The method of claim 5, wherein the displacement coefficient is computed from the flow capacity and the storage capacity of the unswept region in the subterranean reservoir.

7. The method of claim 1, wherein the displacement coefficient is a Hydrocarbon Lorenz Coefficient.

8. The method of claim 1, wherein the displacement coefficient is computed responsive to streamline segments being saturated with oil.

9. The method of claim 8, wherein the streamline segments represent fluid flow between an injection well and a production well.

10. A method for optimizing sweep efficiency of an enhanced oil recovery process in a subterranean reservoir, the method comprising:

(a) providing a subterranean reservoir and a reservoir flow model representative of the subterranean reservoir, the subterranean reservoir having an injection well and a production well;

(b) performing streamline simulation utilizing the reservoir flow model to define streamlines representative of fluid flow between the injection well and the production well;

(c) computing a displacement coefficient responsive to streamlines producing an oil volumetric flow, the displacement coefficient being indicative of heterogeneity in an unswept region of the subterranean reservoir;

(d) determining a functional relationship between the displacement coefficient and a well control device, the well control device being associated with at least one of the injection well and the production well; and (e) optimizing the sweep efficiency of the enhanced oil recovery process in the subterranean reservoir by adjusting the well control device responsive to the functional relationship such that the displacement coefficient is minimized.

11. The method of claim 10, wherein a simulation input deck defining operational values of the well control device is utilized for performing the streamline simulation in step (b).

12. The method of claim 10, wherein the simulation input deck is constructed using operational values of the well control device selected using a Design of Experiment sampling technique.

13. The method of claim 10, wherein the displacement coefficient is computed in step (c) from a flow capacity and a storage capacity of the unswept region in the subterranean reservoir.

* * * * *